US009296576B2

(12) United States Patent
Kobayashi

(10) Patent No.: US 9,296,576 B2
(45) Date of Patent: Mar. 29, 2016

(54) MEDIUM CONVEYING DEVICE AND IMAGE FORMING APPARATUS

(71) Applicant: Oki Data Corporation, Tokyo (JP)

(72) Inventor: Yuta Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/581,024

(22) Filed: Dec. 23, 2014

(65) Prior Publication Data

US 2015/0183597 A1 Jul. 2, 2015

(30) Foreign Application Priority Data

Dec. 27, 2013 (JP) ..... 2013-272581

(51) Int. Cl.

| | |
|---|---|
| ***B65H 3/06*** | (2006.01) |
| ***B65H 7/04*** | (2006.01) |
| ***B65H 7/14*** | (2006.01) |
| ***G03G 15/00*** | (2006.01) |
| ***B65H 1/04*** | (2006.01) |
| ***B65H 3/42*** | (2006.01) |

(52) U.S. Cl.

CPC ..... *B65H 3/0684* (2013.01); *B65H 1/04* (2013.01); *B65H 3/42* (2013.01); *B65H 7/04* (2013.01); *B65H 7/14* (2013.01); *G03G 15/6502* (2013.01); *G03G 2215/00725* (2013.01)

(58) Field of Classification Search

CPC .... B65H 3/0684; B65H 1/26; B65H 2407/21; B65H 2405/12; B65H 7/04; B65H 7/14; G03G 15/6502; G03G 15/6414; G03G 2215/00725

USPC ..... 271/38, 9.09

See application file for complete search history.

(56) References Cited

U.S. PATENT DOCUMENTS

| | | | | |
|---|---|---|---|---|
| 5,897,112 | A * | 4/1999 | Kwag | 271/38 |
| 6,152,631 | A * | 11/2000 | Park | 400/708 |
| 7,692,825 | B2 * | 4/2010 | Koga et al. | 358/496 |
| 8,042,801 | B2 * | 10/2011 | You | 271/157 |
| 8,070,153 | B2 * | 12/2011 | Kang | 271/164 |
| 2002/0084574 | A1 * | 7/2002 | Kim | 271/118 |
| 2009/0129790 | A1 * | 5/2009 | Kang | 399/23 |
| 2014/0353907 | A1 * | 12/2014 | Hara | 271/162 |

FOREIGN PATENT DOCUMENTS

JP 2011-093655 A 5/2011

* cited by examiner

*Primary Examiner* — Patrick Cicchino

(74) *Attorney, Agent, or Firm* — Panitch Schwarze Belisario & Nadel LLP

(57) ABSTRACT

A medium conveying device includes a medium placing tray provided on a main body of an image forming apparatus to be openable and closable. The medium placing tray includes a placing portion on which a medium is placed. The medium conveying device includes a first displacement member including a contact portion that contacts the medium placed on the placing portion and a first engaging portion, and a second displacement member including a second engaging portion that engages the first engaging portion. A detecting unit detects a displacement state of the second displacement member. A determination unit determines the presence or absence of the medium on the placing portion based on a detection result of the detection unit. The first engaging portion and the second engaging portion engage and disengages from each other in conjunction with opening and closing operation of the medium placing tray.

18 Claims, 24 Drawing Sheets

MEDIUM CONVEYING DEVICE AND IMAGE FORMING APPARATUS

BACKGROUND OF THE INVENTION

The present invention relates to a medium conveying device and an image forming apparatus using the medium conveying device.

A general medium conveying device has a medium detection sensor including a lever disposed in a conveying path of a medium. The lever is rotated by the medium, and interrupts a light path of a photosensor. The medium detection sensor detects the medium based on whether the light path is interrupted or not. Such a medium conveying device is disclosed in, for example, Japanese Laid-open Patent Publication No. 2011-93655 (FIG. 4).

In this regard, there is a difficulty in securing a space for providing the lever.

SUMMARY OF THE INVENTION

An object of the present disclosure is to make it easier to secure a space.

According to the present disclosure, there is provided a medium conveying device provided on an image forming apparatus. The medium conveying device includes a medium placing tray provided on a main body of the image forming apparatus so as be openable and closable with respect to the main body. The medium placing tray includes a placing portion on which a medium is placed. The medium conveying device further includes a first displacement member including a contact portion that contacts the medium placed on the placing portion and a first engaging portion, and a second displacement member including a second engaging portion that engages the first engaging portion. The medium conveying device further includes a detecting unit that detects a displacement state of the second displacement member, and a determination unit that determines presence or absence of the medium on the placing portion based on a detection result of the detection unit. The first engaging portion and the second engaging portion engage each other and disengages from each other in conjunction with opening and closing operation the medium placing tray.

With such a configuration, it becomes easier to secure a space.

DETAILED DESCRIPTION OF THE PREFERRED EMBODIMENT

Embodiments of the present invention will be described with reference to the attached drawings.

Embodiment 1

Figure 1:
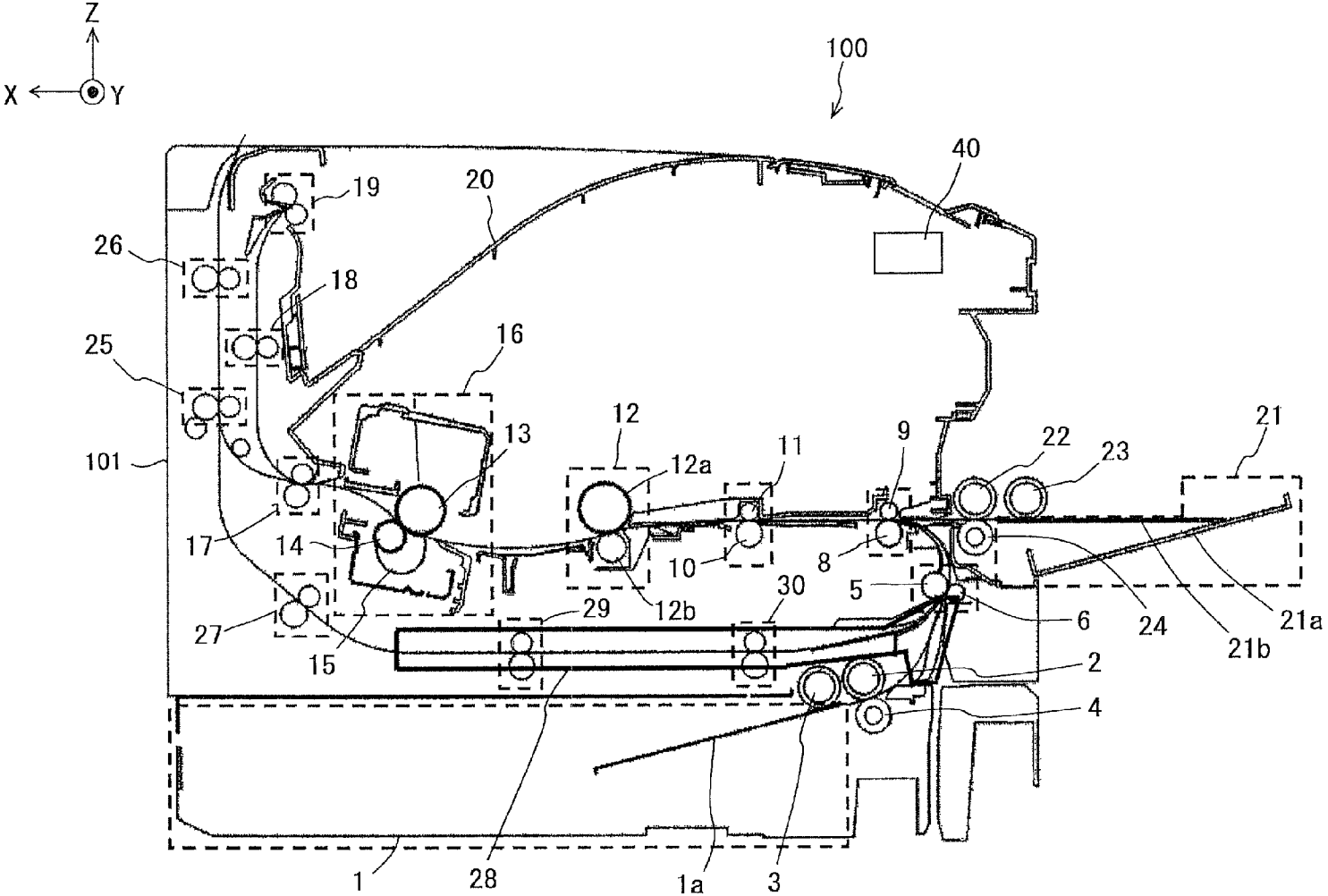
FIG. 1 is a schematic side view showing a printer including a medium conveying device according to Embodiment 1 of the present invention.

FIG. 1 is a schematic side view showing a printer 100 including a medium conveying device according to Embodiment 1 of the present invention.

As shown in FIG. 1, the printer 100 as an image forming apparatus has a function of an electrophotographic printer that forms an image using an LED (Light Emitting Diode). The printer 100 includes a feeding cassette 1, and a manual tray 21 as a manual feeding unit (or a medium placing tray). The manual tray 21 may also be referred to as an MPT (Multi-Purpose Tray). The manual tray 21 includes a manual tray base 21*a* (described later) and a sheet receiving portion 21*b*. When the manual tray 21 is to be used, the manual tray 21 is opened with respect to a main body 101 of the printer 100.

The feeding cassette 1 includes a sheet receiver 1*a* provided on a sheet ejection side thereof. The sheet receiver 1*a* is biased upward by a push-up spring (not shown). A feeding sub-roller 3 for feeding a recording sheet is provided so as to face the sheet receiver 1*a* via the recording sheets on the sheet receiver 1*a*. A feeding roller 2 are provided adjacent to the feeding sub-roller 3. A separation roller 4 is provided so as to face the feeding roller 2. The separation roller 4 separates the recording sheet from other recording sheets placed on the sheet receiver 1*a*. The feeding roller 2 and the feeding sub-roller 3 are driven to rotate by a feeding motor (not shown).

An intermediate conveying roller 5 and a pinch roller 6 are provided downstream of the feeding sub-roller 3 and the feeding roller 2 in a conveying direction of the recording sheet. The pinch roller 6 is pressed against the intermediate conveying roller 5, and rotates following a rotation of the intermediate conveying roller 5. A registration roller 8 and a pressure roller 9 are provided downstream of the intermediate conveying roller 5 and the pinch roller 6 in the conveying direction of the recording sheet. The pressure roller 9 is pressed against the registration roller 8, and rotates following a rotation of the registration roller 8. The registration roller 8 corrects a skew of the recording sheet. An intermediate conveying roller 10 and a pressure roller 11 are provided downstream of the registration roller 8 and the pressure roller 9 in the conveying direction of the recording sheet. The pressure roller 11 is pressed against the intermediate conveying roller 10, and rotates following a rotation of the intermediate conveying roller 10. An image forming unit 12 is provided downstream of the intermediate conveying roller 10 and the pressure roller 11 in the conveying direction of the recording sheet. The image forming unit 12 is configured to form a toner image, and to transfer the toner image to the recording sheet.

A fixing unit 16 is provide downstream of the image forming unit 12 in the conveying direction of the recording sheet. The fixing unit 16 includes a fixing roller 13, a pressure roller 14 and a pressure belt 15. The fixing roller 13 is driven to rotate by a fixing motor (not shown). The pressure roller 14 and the pressure belt 15 rotate following a rotation of the fixing roller 13. The fixing roller 13 has an internal heat source. The toner image (transferred to the recording sheet by the image forming unit 12) is molten by heat generated by the heater of the fixing roller 13, and is fixed to the recording sheet.

Ejection roller pairs 17, 18 and 19 are provided downstream of the fixing unit 16 in the conveying direction of the recording sheet. The ejection roller pairs 17, 18 and 19 are configured to eject the recording sheet. A stacker 20 (i.e., a placing surface) is provided on, for example, a cover member of the printer 100. The recording sheet ejected by the ejection roller pair 19 is placed on the stacker 20.

The manual tray 21 as the medium placing tray includes the sheet receiving portion 21*b* biased upward by a biasing member (not shown) such as a spring. An MPT sub-roller 23 (i.e., a feeding unit or a second roller) for feeding the recording sheet is provided so as to face the sheet receiving portion 21*b* via the recording sheet on the sheet receiving portion 21*b*. An MPT roller 22 (i.e., a first roller) is provided adjacent to the MPT sub-roller 23. An MPT separation roller 24 is provided so as to face the MPT roller 22. The MPT separation roller 24 separates the recording sheet from other recording sheets placed on the sheet receiving portion 21*b*. The MPT roller 22 and the MPT sub-roller 23 are driven to rotate by a feeding motor (not shown).

The above described registration roller 8 and the pressure roller 9 are provided downstream of the MPT roller 22 in the conveying direction of the recording sheet fed from the sheet receiving portion 21*b*. The registration roller 8 corrects the skew of the recording sheet fed from the manual tray 21. The recording sheet fed from the manual tray 21 is conveyed by the registration roller 8, proceeds along the same conveying path as the recording sheet fed from the feeding cassette 1, and is ejected to the stacker 20.

A path-selector (not shown) is provided downstream of the ejection roller pair 17 in the conveying direction of the recording sheet. The path-selector selects between a medium ejection path along which the ejection roller pairs 18 and 19 are provided, and a duplex printing conveying path along which duplex printing conveying roller pairs 25, 26, 27, 29 and 30 are provided. A duplex printing conveying unit 28 is detachably mounted to the main body 101 of the printer 100. The duplex printing conveying unit 28 is disposed on the duplex printing conveying path. When the duplex printing conveying unit 28 is mounted to the main body 101 of the printer 100, the recording sheet is conveyed to the intermediate conveying roller 5 by the duplex printing conveying roller pairs 29 and 30.

In FIG. 1, an X direction is defined as a conveying direction of the recording sheet when the recording sheet passes through the intermediate conveying roller 10 and the pressure roller 11. Further, a Y direction is defined as a direction of a rotation axis of the intermediate conveying roller 10. Further, a Z direction is defined as a direction perpendicular to both of the X direction and the Y direction. Each of the X direction, the Y direction and the Z direction indicates the same direction when shown in other drawings. Further, the X direction, the Y direction and the Z direction indicate directions with respect to components shown in respective drawings when the components are mounted to the printer 100 shown in FIG. 1. Here, the Z direction indicates a substantially vertical direction.

A printing operation of the above configured printer 100 will be described.

In FIG. 1, the feeding sub-roller 3 rotates to feed the recording sheet set in the feeding cassette 1. The feeding roller 2 and the separation roller 4 separate the recording sheet from other recording sheets on the feeding cassette 1, and feed the recording sheet to the intermediate conveying roller 5 and the pinch roller 6. The recording sheet is pressed against a nip portion between the registration roller 8 and the pressure roller 9 by a force of the intermediate conveying roller 5. The recording sheet is pressed against the nip portion for a predetermined time period, so that the skew of the recording sheet is corrected. Then, the registration roller 8 starts rotating, and conveys the recording sheet to the intermediate conveying roller 10 and the pressure roller 11. The intermediate conveying roller 10 rotates to convey the recording sheet to the image forming unit 12.

In the image forming unit 12, a toner image (i.e., a developer image) is formed on a surface of a photosensitive drum (i.e., an image bearing body) 12*a* using charging, exposing and developing processes of electrophotography. A transfer member 12*b* transfers the toner image from the surface of the photosensitive drum 12*a* to the recording sheet conveyed through the photosensitive drum 12*a* and the transfer member 12*b*, and conveys the recording sheet to the fixing unit 16. In the fixing unit 16, the fixing roller 13 applies heat to the recording sheet, and the pressure roller 14 and the pressure belt 15 apply pressure to the recording sheet, so that the toner image is fixed to the recording sheet. The fixing unit 16 conveys the recording sheet to the ejection roller pair 17.

In the case where the recording sheet with the fixed toner image is to be ejected, the path-selector guides the recording sheet to the medium ejection path. In this case, the ejection roller pairs 18 and 19 eject the recording sheet, and the ejected recording sheet is placed on the stacker 20. In the case of the duplex printing, the path-selector guides the recording sheet to the duplex printing conveying path. In this case, the recording sheet is first conveyed to the duplex printing conveying roller pairs 25 and 26. The duplex printing conveying roller pairs 25 and 26 rotate to convey the recording sheet until a trailing edge of the recording sheet reaches a nip portion of the duplex printing conveying roller pair 25. When the trailing edge of the recording sheet reaches the nip portion of the duplex printing conveying roller pair 25, the duplex printing conveying roller pairs 25 and 26 reverse the rotating directions, and convey the recording sheet to the duplex printing conveying roller pairs 27, 29 and 30. The duplex printing conveying roller pairs 27, 29 and 30 rotate to convey the recording sheet to the intermediate conveying roller 5 and the pinch roller 6 for printing on a back surface of the recording sheet.

The ejection roller pairs 17, 18 and 19 are driven to rotate by the fixing motor that drives the fixing roller 13. The duplex printing conveying roller pairs 25, 26, 27, 29 and 30 are driven to rotate by a duplex printing motor (not shown).

In the case of printing on the recording sheet fed from the manual tray 21, the MPT sub-roller 23 rotates to feed the recording sheet placed on the sheet receiving portion 21*b*. The MPT roller 22 and the MPT separation roller 24 separate the recording sheet from other recording sheets on the sheet receiving portion 21*b*, and feed the recording sheet. The recording sheet is pressed against a nip portion between the registration roller 8 and the pressure roller 9 by a force of the MPT roller 22. Thereafter, the recording sheet is conveyed, is subjected to printing, and is ejected to the stacker 20 in a similar manner to the recording sheet fed from the feeding cassette 1.

Next, configurations and functions of the manual tray 21, the MPT roller 22 and the MPT sub-roller 23 will be described in detail.

Figure 2:
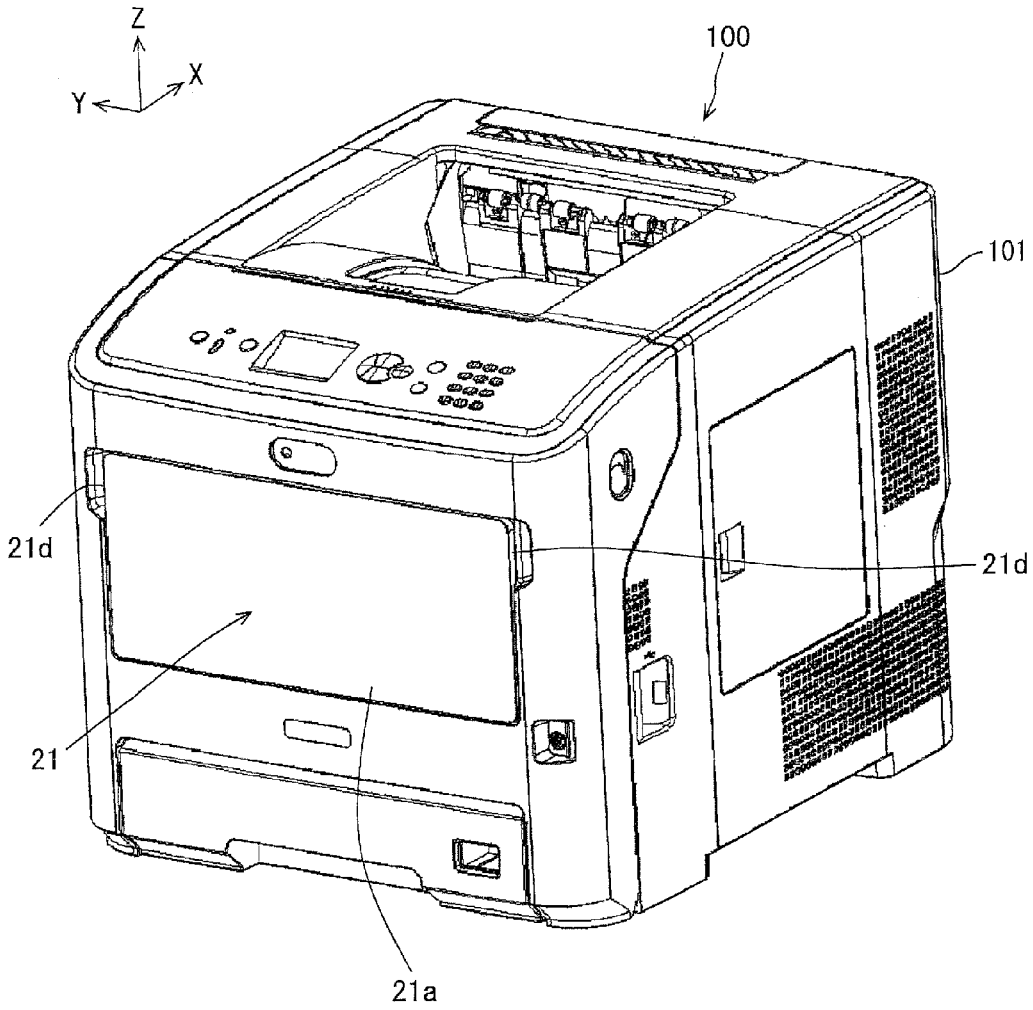
FIG. 2 is an external perspective view showing the printer according to Embodiment 1 in a state where a manual tray is retracted.
Figure 3:
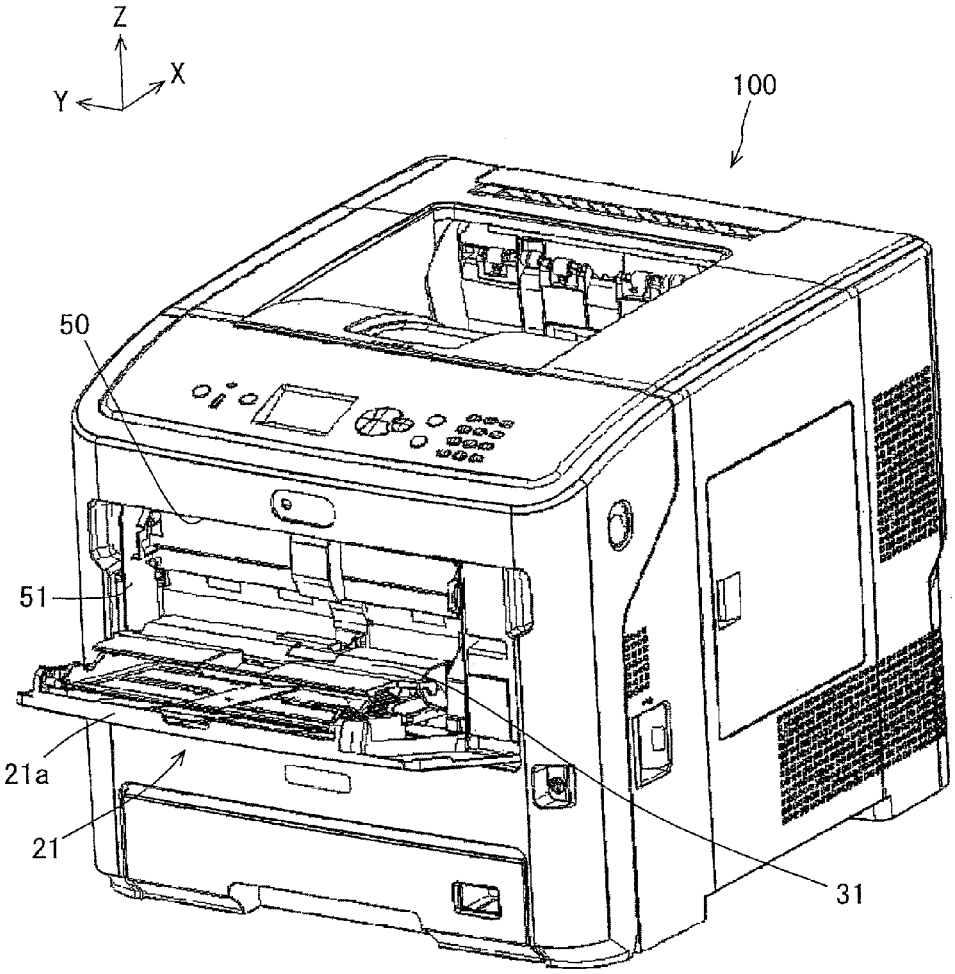
FIG. 3 is an external perspective view showing the printer according to Embodiment 1 in a state where the manual tray is opened.
Figure 4:
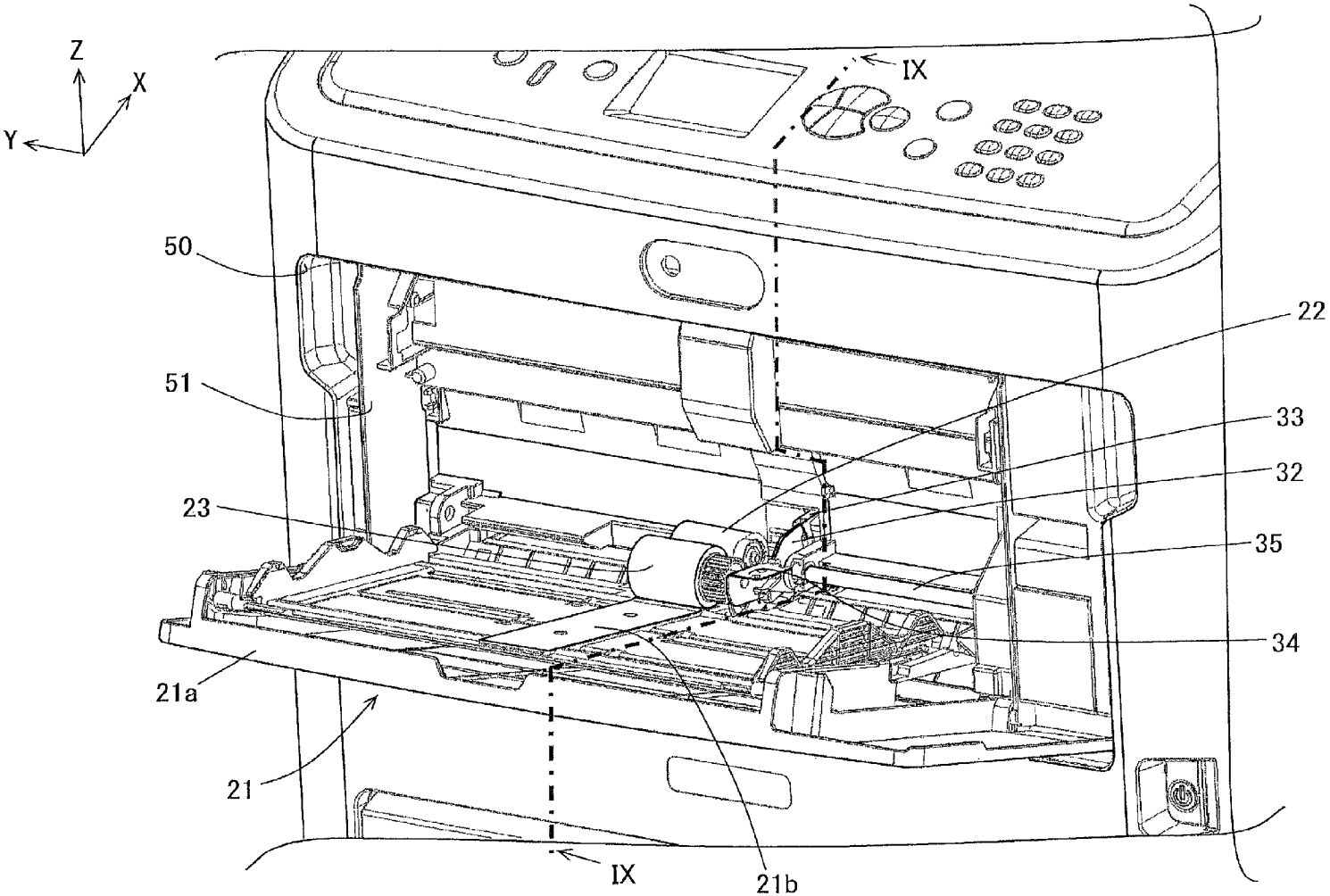
FIG. 4 is an enlarged view showing a part of the printer according to Embodiment 1 with an MPT frame being removed.
Figure 5:
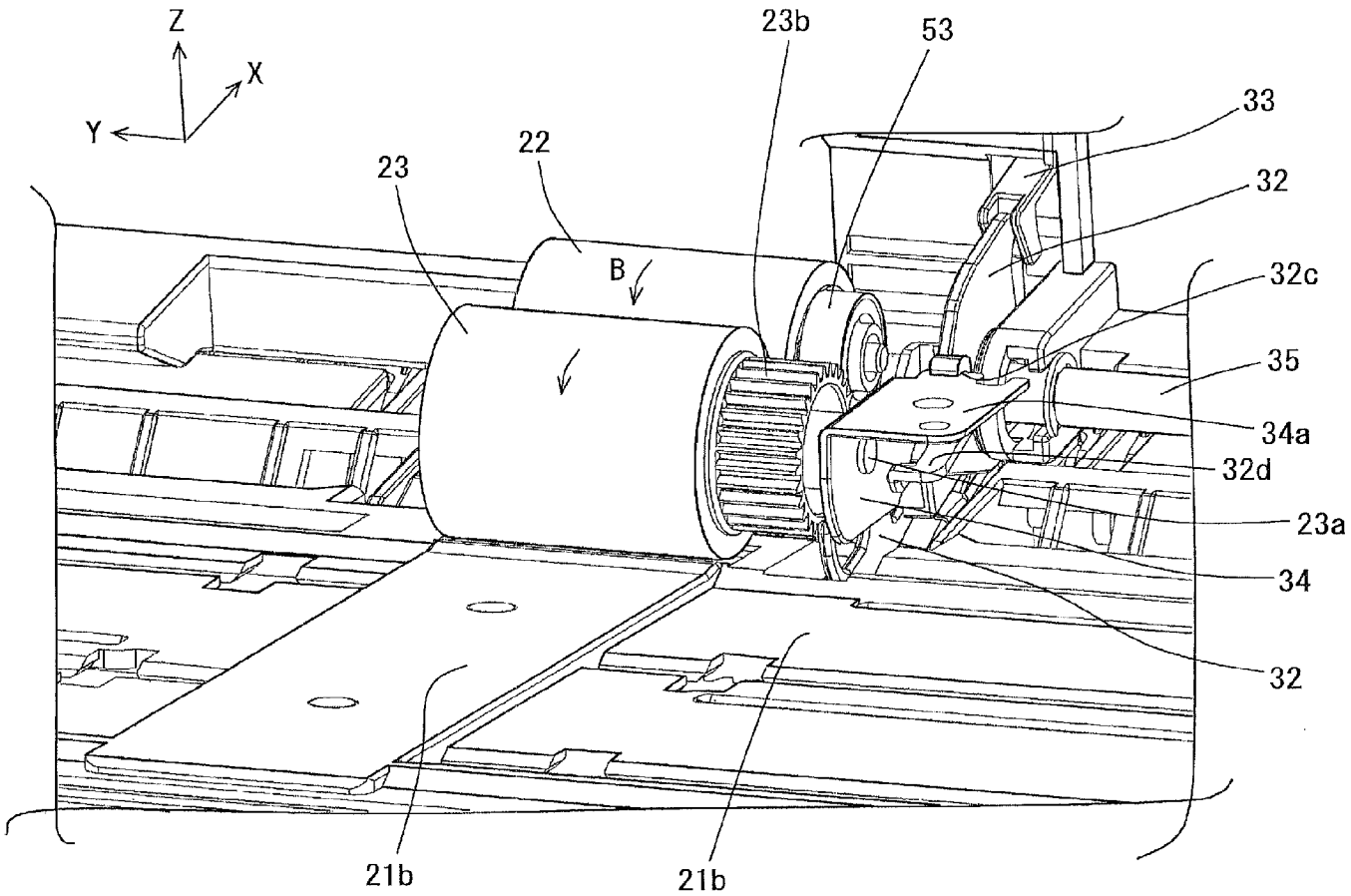
FIG. 5 is an enlarged view showing the vicinity of an MPT sub-roller according to Embodiment 1.
Figure 9:
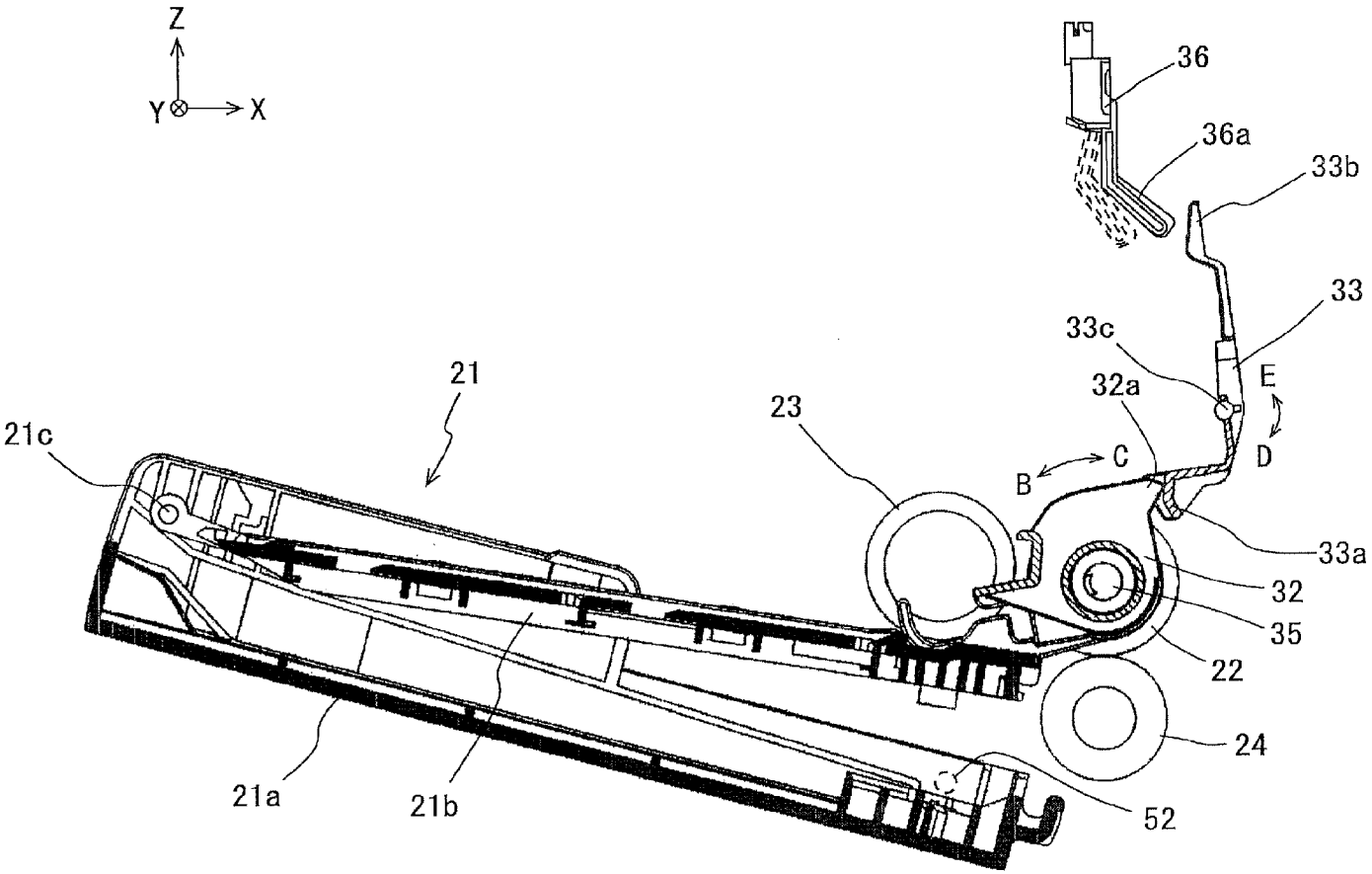
FIG. 9 is a sectional view taken along line IX-IX in FIG. 4.

FIG. 2 is an external perspective view showing the printer 100 in a state where the manual tray 21 is retracted. FIG. 3 is an external perspective view showing the printer 100 in a state where the manual tray 21 is opened. FIG. 4 is an enlarged view showing a part of the printer 100 with an MPT frame 31 being removed. FIG. 5 is an enlarged view showing the vicinity of the MPT sub-roller 23 shown in FIG. 4. FIG. 9 is a sectional view taken along line IX-IX in FIG. 4. FIGS. 11 through 16 are schematic views showing a rotation operation of the manual tray according to Embodiment 1.

The manual tray base 21*a* of the manual tray 21 is supported by a main body frame 51 (i.e., a frame of the main body 101) so that the manual tray base 21*a* is rotatable about a rotation shaft 52 (FIG. 9) parallel to the Y direction. As shown in FIG. 2, the manual tray base 21*a* is rotatable (i.e., openable and closable) between a closed position shown in FIG. 2 and an opening position shown in FIG. 3. When the manual tray base 21*a* is in the closing position shown in FIG. 2, the manual tray base 21*a* closes a sheet receiving opening 50*a* formed on a front surface of the printer 100. When the manual tray base 21*a* is in the opening position shown in FIG. 3, the manual tray 21 is usable. The manual tray 21 includes grip portions 21*d* provided on lateral ends thereof. The grip portions 21*d* are held by a user for opening the manual tray 21 from the closing position.

As shown in FIG. 9, the manual tray base 21*a* supports the sheet receiving portion 21*b* (i.e., a placing portion) so that the sheet receiving portion 21*b* is rotatable about a rotation shaft 21*c* provided on an end of the manual tray base 21*a*. The sheet receiving portion 21*b* is biased upward by the biasing member (not shown) such as a spring, and presses the recording sheets placed thereon against the MPT sub-roller 23.

The MPT frame 31 (see FIGS. 3 and 11) is supported by the main body frame 51 so that the MPT frame 31 is rotatable about a rotation axis which is coaxial with a shaft 35*a*. The shaft 35*a* is provided on the main body frame 51 so as to be parallel to the Y direction. The MPT frame 31 rotates between an opening position and a closing position (described later) in conjunction with a rotation of the manual tray base 21*a*. In other words, the manual tray base 21*a* and the MPT frame 31 are linked with each other by, for example, linking members (not shown) which are slidable with respect to each other.

The MPT roller 22 is disposed at a center of the sheet receiving opening 50 in a widthwise direction of the sheet receiving opening 50 (i.e., the Y direction). The MPT roller 22 is supported by the main body frame 51 so that the MPT roller 22 is rotatable about the shaft 35. The MPT roller 22 is driven by a driving unit (not shown) to rotate in a direction shown by an arrow B at a predetermined timing. The MPT sub-roller 23 is supported by an MPT sub-frame 34 (i.e., a holder). The MPT sub-frame 34 is fixed to the MPT frame 31, and is rotatable about the shaft 35. A rotation shaft 23*a* of the MPT sub-roller 23 is parallel to the shaft 35. A rotation of the MPT roller 22 is transmitted to a gear portion 23*b* of the MPT sub-roller 23 via an intermediate gear 53 rotatably supported by the MPT frame 31. Therefore, the MPT sub-roller rotates in the same direction as the MPT roller 22 following the rotation of MPT roller 22.

Figure 11:
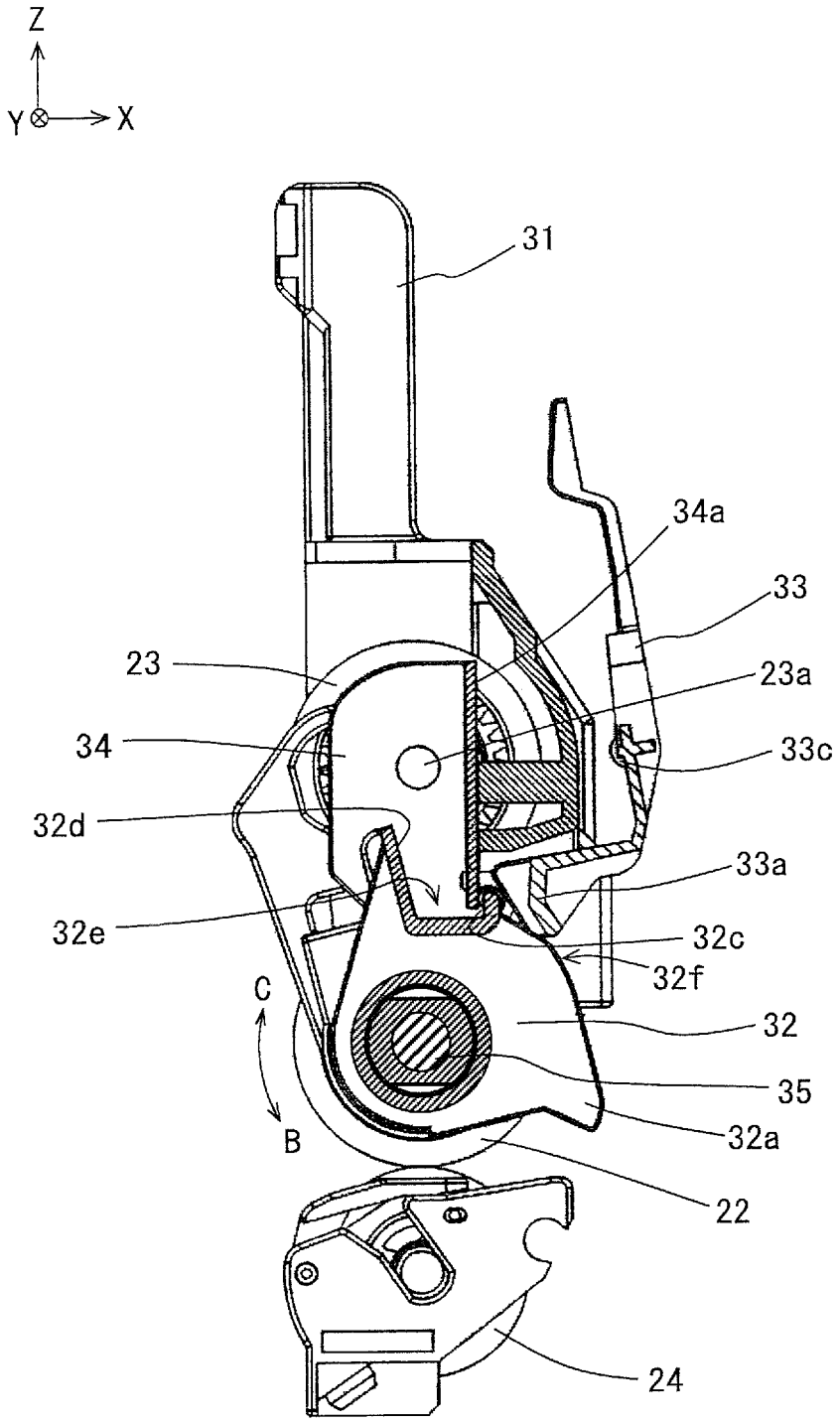
FIG. 11 is a schematic view showing a rotation operation of the manual tray according to Embodiment 1.
Figure 16:
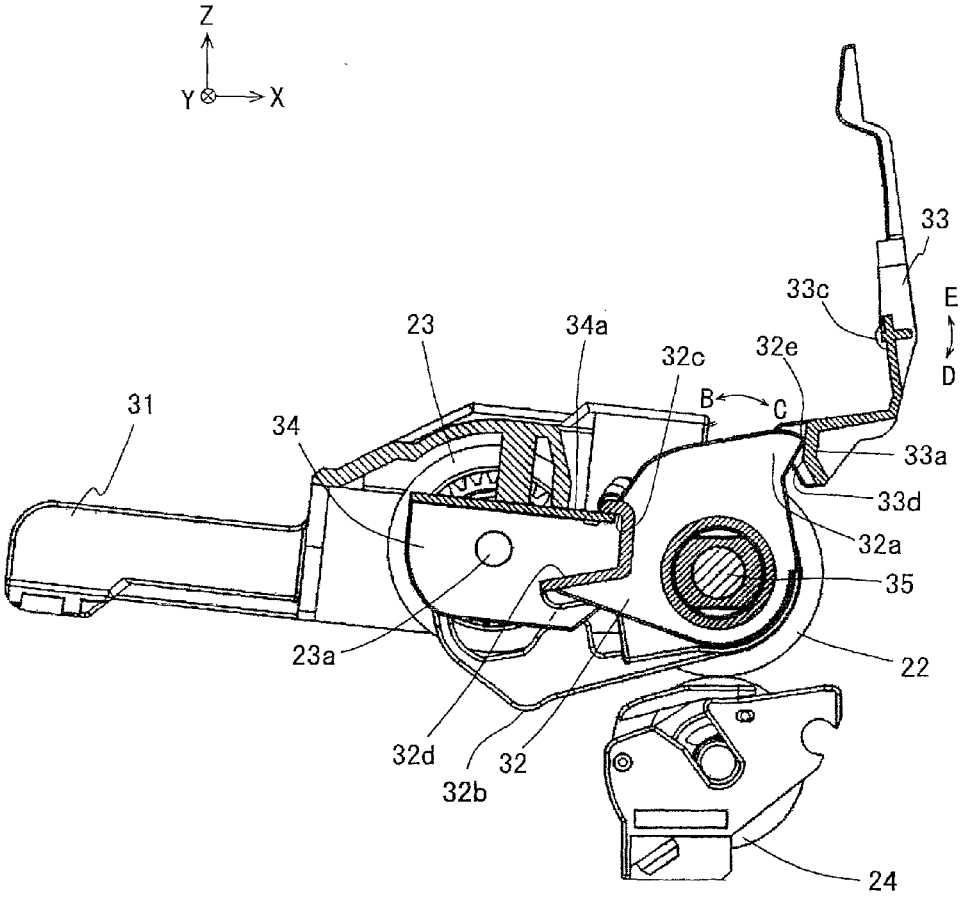
FIG. 16 is a schematic view showing the rotation operation of the manual tray according to Embodiment 1.

Therefore, when the manual tray 21 is closed as shown in FIG. 2, the MPT frame 31 and the MPT sub-frame 34 are in the closing rotational position where the MPT sub-roller 23 is located directly above the MPT roller 22 as shown in FIG. 11. When the manual tray 21 is opened as shown in FIG. 3 so that the manual tray 21 is usable, the MPT frame 31 and the MPT sub-frame 34 are in an opening rotational Position where the MPT sub-roller 23 is located substantially at the same height as but slightly higher than the MPT roller 22 as shown in FIG. 16.

Figure 6B:
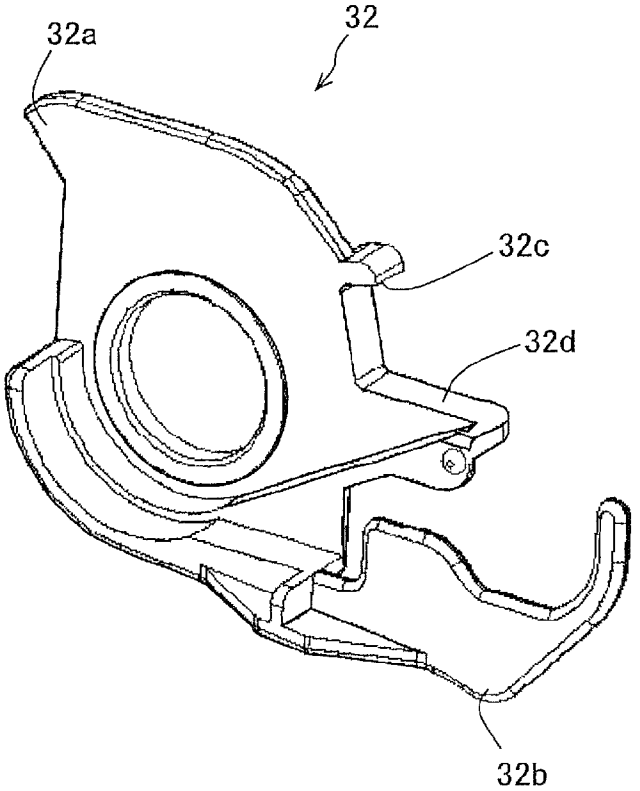
FIGS. 6A and 6B are perspective views showing a first MPT lever according to Embodiment 1 as seen in different directions.
Figure 6A:
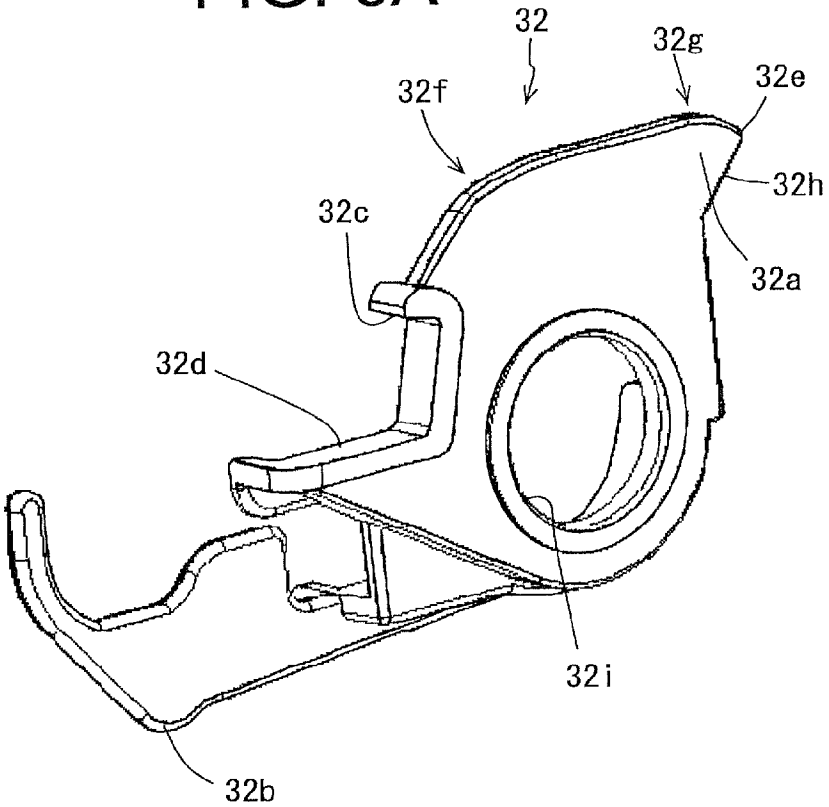

Next, configurations and functions of a first MPT lever 32 as a first displacement member, a second MPT lever 33 as a second displacement member, and a mechanical switch 36 as a detection unit will be described. FIGS. 6A and 6B are perspective views showing the first MPT lever 32 as seen in different directions.

As shown in FIGS. 6A and 6B, the first MPT lever 32 has a shaft hole 32*i* through which the shaft 35 is inserted. As shown in FIG. 5, the first MPT lever 32 is disposed in the vicinity of the MPT roller 22, and is rotatably supported by the shaft 35. As shown in FIGS. 6A and 6B, a normal-direction contact portion 32*c* and a reverse-direction contact portion 32*d* are formed on a periphery of the MPT lever 32. The normal-direction contact portion 32*c* and the reverse-direction contact portion 32*d* are formed so as to face each other. A regulating portion 34*a* (i.e., a third engaging portion) is formed on the MPT sub-frame 34, and is located between the normal-direction contact portion 32*c* and the reverse-direction contact portion 32*d* (see FIG. 11).

FIG. 9 shows a state where the manual tray base 21*a* of the manual tray 21 is in the closing position, and the sheet receiving portion 21*b* contacts the MPT sub-roller 23. In FIG. 9, the second MPT lever 33 has a rotation shaft 33*c* rotatably supported by the main body frame 51. The second MPT lever 33 has an engaging wall 33*a* (i.e., a second engaging portion) and a pushing portion 33*b* (i.e., a to-be-detected portion). The engaging wall 33*a* is formed at an end portion of the second MPT lever 33, and the pushing portion 33*b* is formed at the other end portion of the second MPT lever 33. The rotation shaft 33*c* of the second MPT lever 33 is rotatably supported by the main body frame 51. The second MPT lever 33 is supported at a position where the engaging wall 33*a* is contactable with an engaging protrusion 32*a* (i.e., a first engaging portion) of the first MPT lever 32.

The mechanical switch 36 shown in FIG. 9 has a switch lever 36*a*. The mechanical switch 36 is fixed to the main body frame 51 at a position where the pushing portion 33*b* of the second MPT lever 33 is able to push the switch lever 36*a*. The switch lever 36*a* is displaceable between an OFF position shown by a solid line in FIG. 9 and an ON position shown by a dashed line in FIG. 9 as described later.

Figure 7:
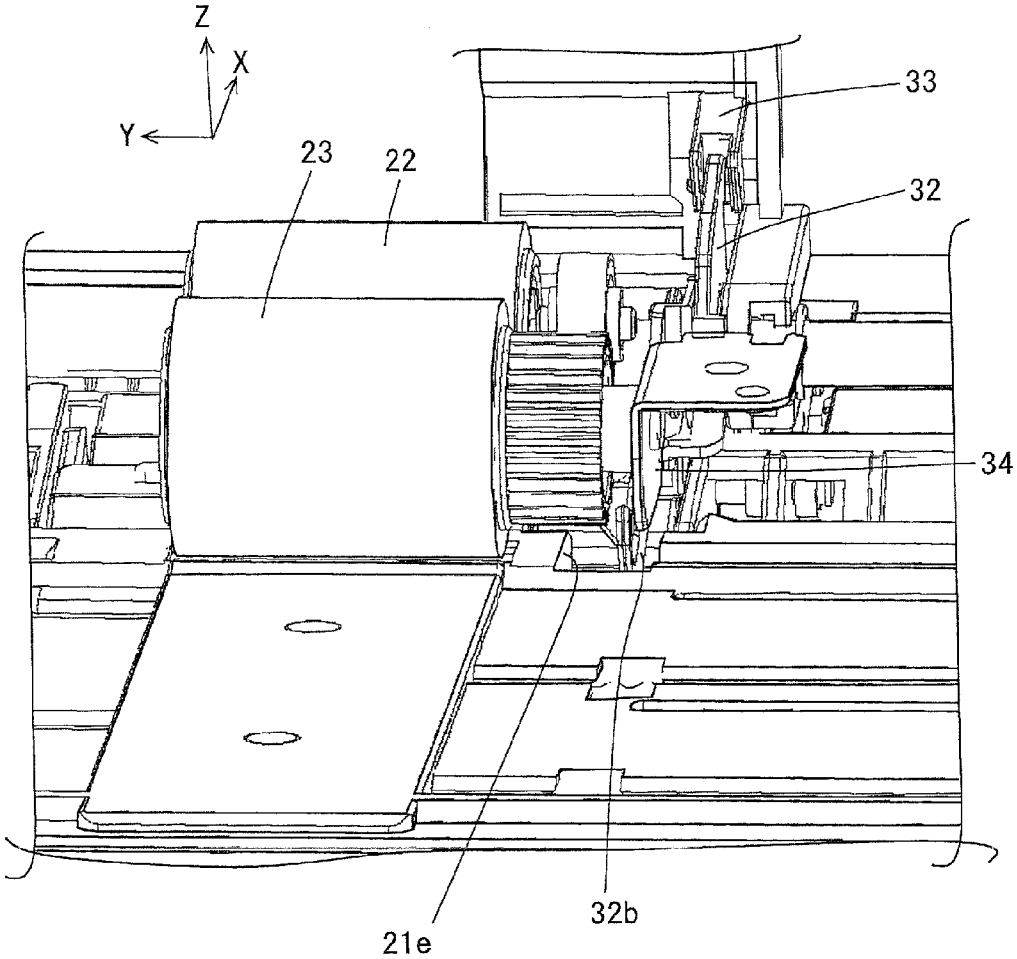
FIG. 7 is a schematic view showing a state where a sheet contact portion of a first MPT lever fits into a receiving recess formed on a sheet receiving portion in a state where a recording sheet is not placed on an MPT according to Embodiment 1.
Figure 8:
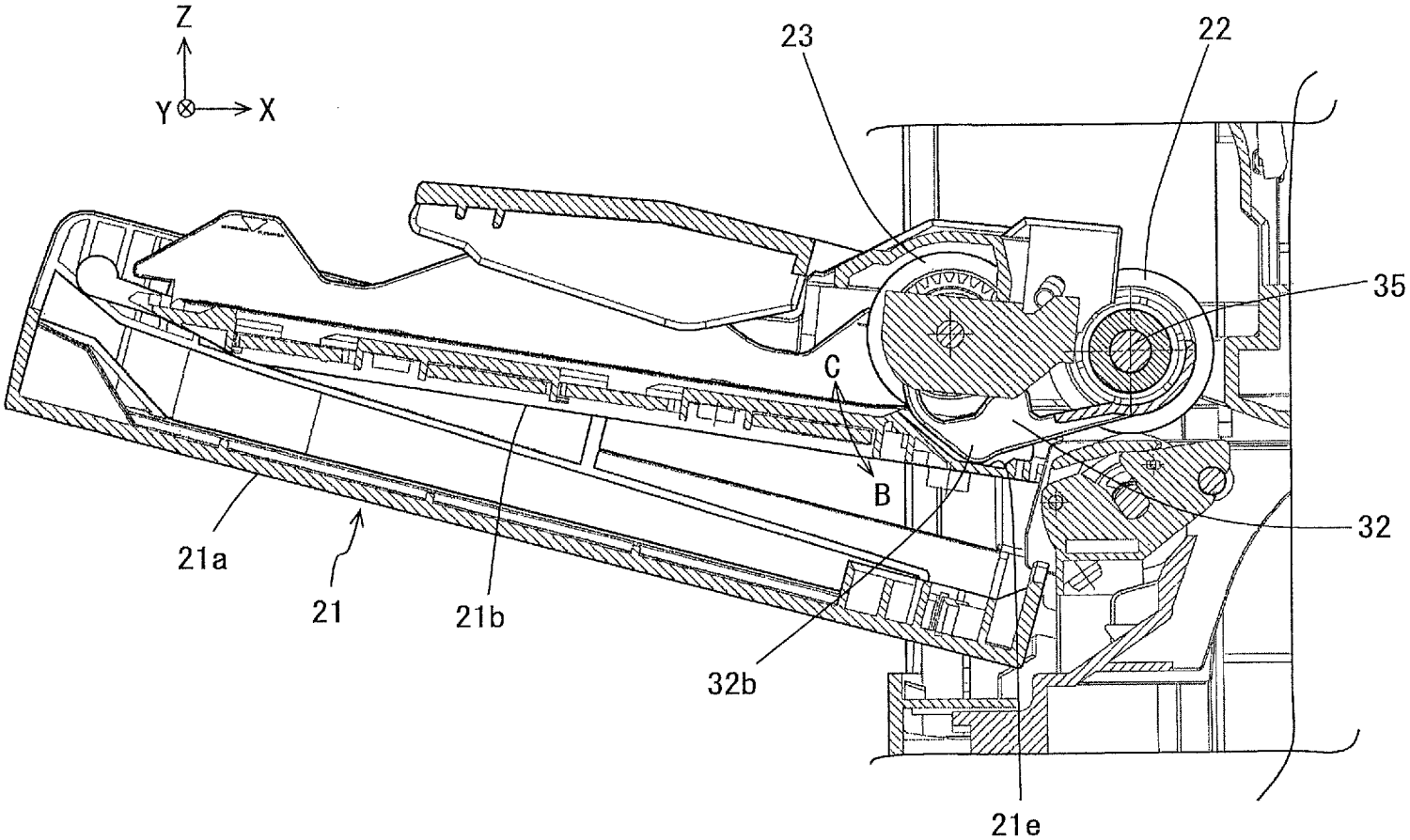
FIG. 8 is a sectional view showing a portion including the receiving recess of the printer according to Embodiment 1 as seen from a negative side in a Y direction.

FIG. 7 shows a state where the recording sheet is not placed on the sheet receiving portion 21*b*, and a sheet contact portion 32*b* (i.e., a contact portion) of the first MPT lever does not contact the recording sheet but fits into a receiving recess 21*e* formed on the sheet receiving portion 21*b*. The receiving recess 21*e* is formed on the sheet receiving portion 21*b* so as to correspond to the sheet contact portion 32*b* of the first MPT lever 23. FIG. 8 is a sectional view of a portion including the receiving recess 21*e* (into which the sheet contact portion 32*b* fits) as seen from a negative side in the Y direction.

As shown in FIGS. 7 through 9, in a state where the manual tray base 21*a* is in the opening position, and the recording sheet is not placed on the sheet receiving portion 21*b*, the first MPT lever 32 is going to rotate in the direction shown by the arrow B by gravity. However, the sheet contact portion 32*b* of the first MPT lever 32 fits into the receiving recess 21*e* (FIG. 7) of the sheet receiving portion 21*b*, and the rotation of the first MPT lever 32 is prevented (see FIG. 16). In this state, the first MPT lever 32 is held in a non-sheet-detection position (also referred to as a non-detection position). The pushing portion 33*b* of the second MPT lever 33 is apart from the switch lever 36*a* of the mechanical switch 36 as shown in FIG. 9. Therefore, the mechanical switch 36 is in an OFF state (i.e., in the OFF position).

Figure 10:
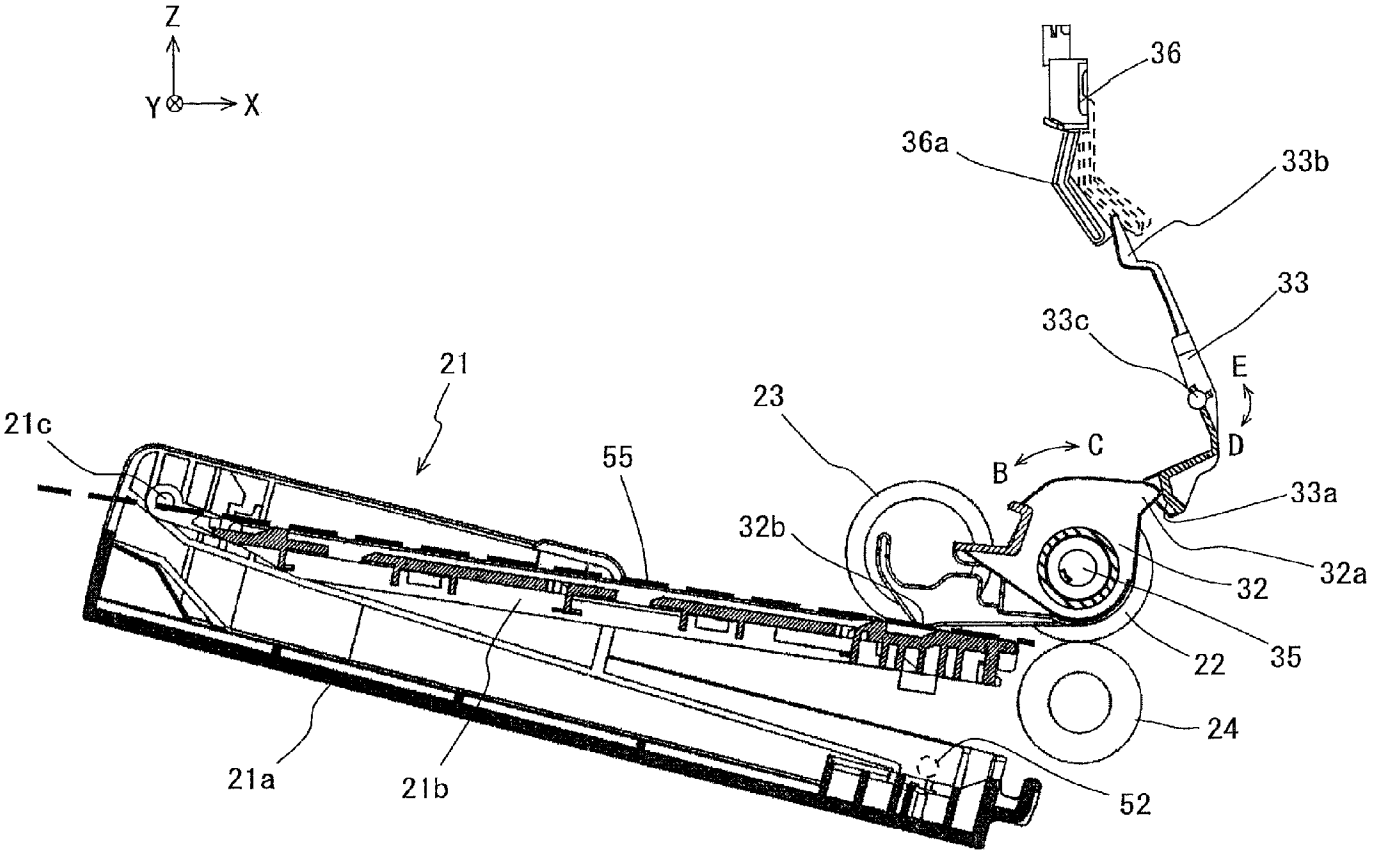
FIG. 10 is a schematic view showing a state where the recording sheet is placed on the sheet receiving portion according to Embodiment 1.

FIG. 10 shows a state where the manual tray base 21*a* of the manual tray 21 is in the opening position, and the recording sheet 55 (shown by a long dashed line) is placed on the sheet receiving portion 21*b*. In this state, the sheet contact portion 32*b* of the first MPT lever 32 contacts the surface of the recording sheet 55, and the first MPT lever 32 is held at a sheet-detection position (also referred to as a detecting position). The sheet-detection position is a position where the first MPT lever 32 slightly rotates in a direction shown by an arrow C from the non-sheet-detection position.

As shown in FIGS. 9 and 10, shapes and positions of the engaging protrusion 32*a* of the first MPT lever 32 and the engaging wall 33*a* of the second MPT lever 33 are determined so that the engaging protrusion 32*a* of the first MPT lever 32 keeps pushing the engaging wall 33*a* of the second MPT lever 33 to cause the second MPT lever 33 to rotate in a direction shown by an arrow E, at least while the first MPT lever 32 rotates from the non-sheet-detection position (FIG. 9) to the sheet-detection position (FIG. 10).

Therefore, as shown in FIG. 10, when the first MPT lever 32 is in the sheet-detection position, the pushing portion 33*b* of the second MPT lever 33 (rotated in the direction shown by the arrow E) displaces the switch lever 36*a* of the mechanical switch 36 from the OFF position shown by the solid line to the ON position shown by the dashed line.

In this way, the mechanical switch 36 is in the OFF state when the manual tray base 21*a* of the manual tray 21 is in the opening position, and the recording sheet is not placed on the sheet receiving portion 21*b*. The mechanical switch 36 is in the ON state when the manual tray base 21*a* of the manual tray 21 is in the opening position, and the recording sheet is placed on the sheet receiving portion 21*b*. The mechanical switch 36 outputs an ON signal and an OFF signal (i.e., a medium detection signal) corresponding to the ON state and the OFF state to a control unit 40 (FIG. 1). The control unit 40 (i.e., a determining unit) receives the medium detection signal from the mechanical switch 36. When receiving the ON signal, the control unit 40 determines that the recording sheet is placed on the sheet receiving portion 21*b*. When receiving the OFF signal, the control unit 40 determines that the recording sheet is not placed on the sheet receiving portion 21*b*.

Operations of the manual tray 21, the MPT roller 22, the MPT sub-roller 23, the first MPT lever 32, and the second MPT lever 33 during a rotation (i.e., an opening operation) of the manual tray 21 from the closing position (FIG. 2) to the opening position (FIG. 3) will be described.

As described above, when the manual tray 21 rotates from the closing position (FIG. 2) to the opening position (FIG. 3), the MPT frame 31 rotates in the direction shown by the arrow B 5, about the shaft 35 from the closing rotational position (FIG. 11) where the MPT sub-roller 23 is located directly above the MPT roller 22 to the opening rotational position (FIG. 16) where the MPT sub-roller 23 is located substantially at the same height as (but slightly higher than) the MPT roller 22.

As shown in FIG. 11, when the MPT frame 31 is in the closing rotational position, the first MPT lever 32 is going to rotate in the direction shown by the arrow B by gravity. In this state, the normal-direction contact portion 32*c* of the first MPT lever 32 keeps contacting the regulating portion 34*a* of the MPT sub-frame 34. The second MPT lever 33 is in a free state in which the engaging wall 33*a* is apart from the first MPT lever 32. In this state, the pushing portion 33*b* of the second MPT lever 33 is apart from the mechanical switch 36 as in the state shown in FIG. 9.

Here, the shape of the first MPT lever 32 will be described. As shown in FIGS. 6A and 6B, the first MPT lever 32 includes a circular arc portion 32*f* and a projecting guide portion 32*g* which are continuously formed along the periphery of the first MPT lever 32 from the normal-direction contact portion 32*c* to the engaging protrusion 32*a*. The circular arc portion 32*f* is formed so that a distance from a rotation center is constant. The projecting guide portion 32*g* is formed on the engaging protrusion 32*a*. Further, an inclination guide portion 32*h* is formed on the periphery of the first MPT lever 32. The inclination guide portion 32*h* and the projecting guide portion 32*g* meet at an apex portion 32*e* of the engaging protrusion 32*a*. The inclination guide portion 32*h* is formed so that a distance from the rotation center significantly decreases as a distance from the apex portion 32*e* increases.

Therefore, when the MPT frame 31 rotates in the direction shown by the arrow B from the state shown in FIG. 11 according to the rotation of the manual tray 21, the first MPT lever 32 rotates in the direction shown by the arrow B keeping the contact between the normal-direction contact portion 32*c* and the regulating portion 34*a* of the MPT sub-frame 34 until the first MPT lever 32 contacts the second MPT lever 33. When the engaging protrusion 32*a* of the first MPT lever 32 contacts the engaging wall 33*a* of the second MPT lever 33 as shown in FIG. 12, the rotation of the first MPT lever 32 in the direction shown by the arrow B is stopped temporarily by a contact friction between the engaging protrusion 32*a* and the engaging wall 33*a*.

Figure 12:
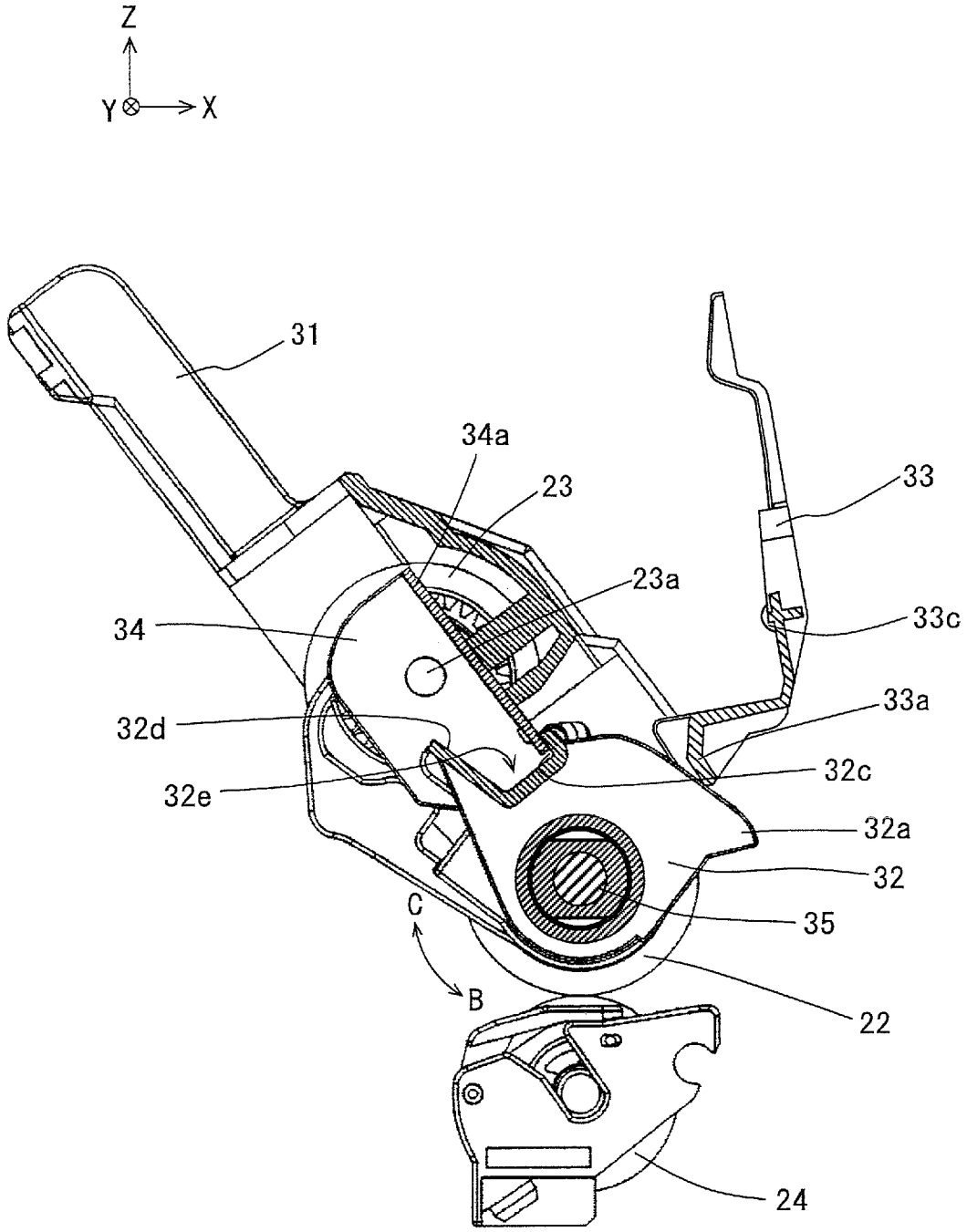
FIG. 12 is a schematic view showing the rotation operation of the manual tray according to Embodiment 1.
Figure 13:
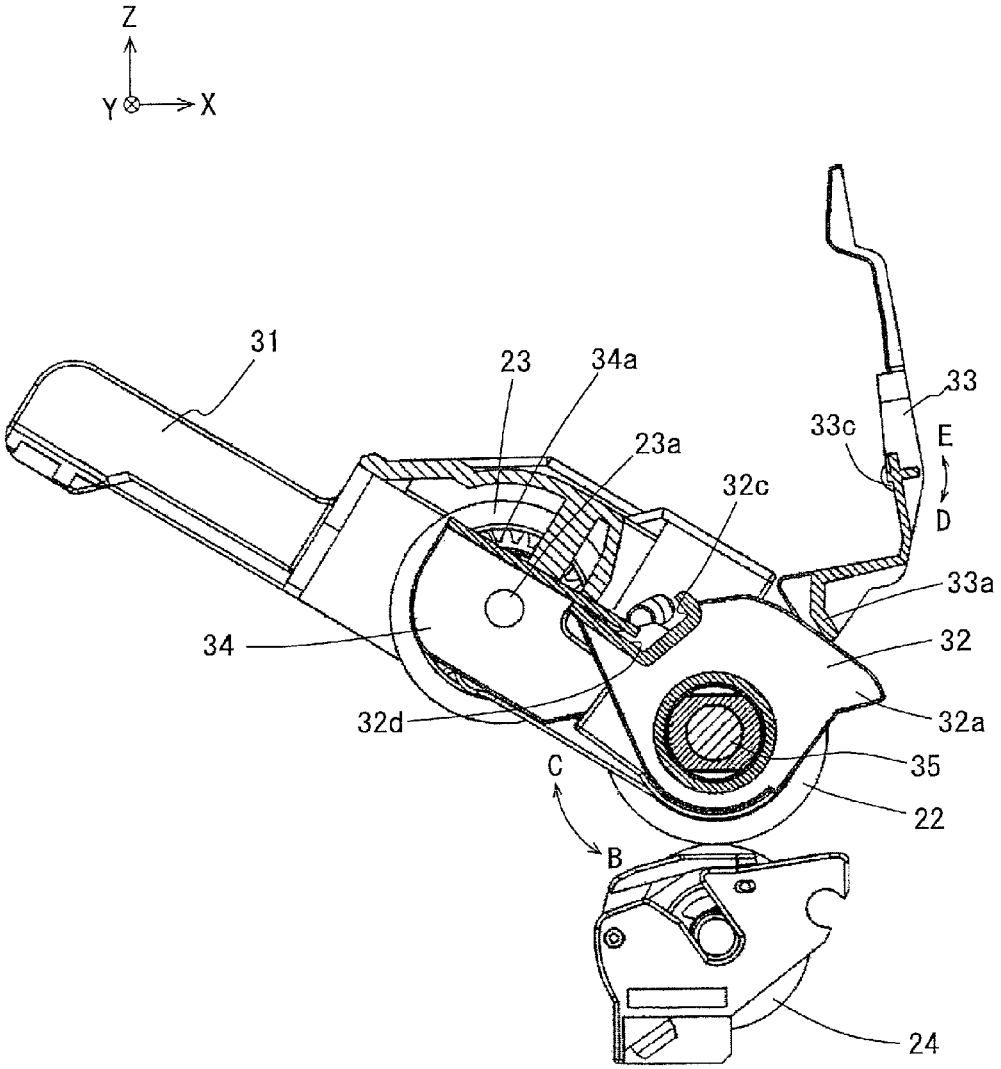
FIG. 13 is a schematic view showing the rotation operation of the manual tray according to Embodiment 1.

The first MPT lever 32 keeps a rotation-stopped state until the MPT frame 31 further rotates in the direction shown by the arrow B from the state shown in FIG. 12 and the regulating portion 34*a* of the MPT sub-frame 34 contacts the reverse-direction contact portion 32*d* as shown in FIG. 13. When the MPT frame 31 further rotates in the direction shown by the arrow B after the regulating portion 34*a* of the MPT sub-frame 34 contacts the reverse-direction contact portion 32*d* of the first MPT lever 32, the first MPT lever 32 rotates in the direction shown by the arrow B. Therefore, the engaging protrusion 32*a* of the first MPT lever 32 starts pushing a lower end portion of the engaging wall 33*a* of the second MPT lever 33, so that the second MPT lever 33 starts rotating in the direction shown by the arrow E.

Figure 14:
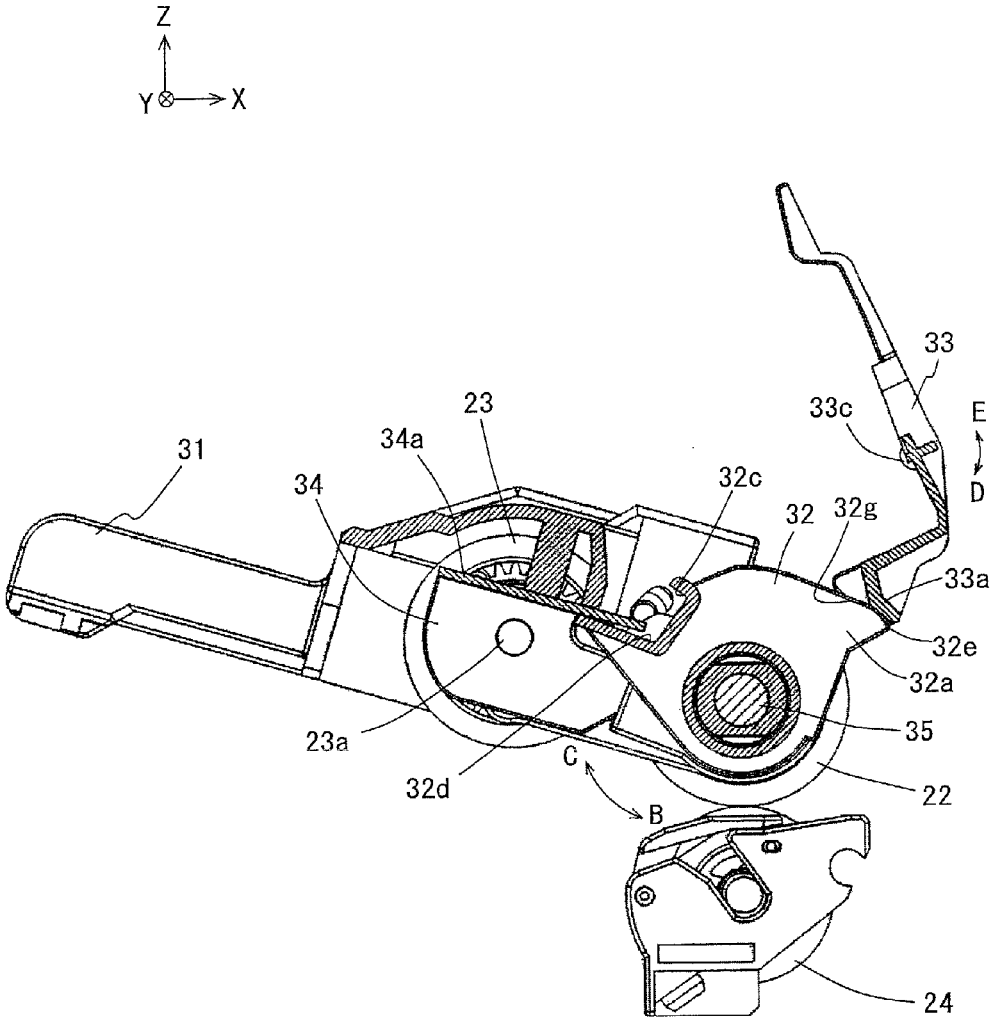
FIG. 14 is a schematic view showing the rotation operation of the manual tray according to Embodiment 1.

FIG. 14 shows a state where the MPT frame 31 rotates in the direction shown by the arrow B from the state shown in FIG. 13 to reach a position where the apex portion 32*e* of the engaging protrusion 32*a* of the first MPT lever 32 (that rotates following the rotation of the MPT frame 31) engages the engaging wall 33*a* of the second MPT lever 33. During this rotation, the lower end portion of the engaging wall 33*a* slides on the projecting guide portion 32*g* of the engaging protrusion 32*a*, and is pushed according to a projecting shape of the projecting guide portion 32*g*.

Figure 15:
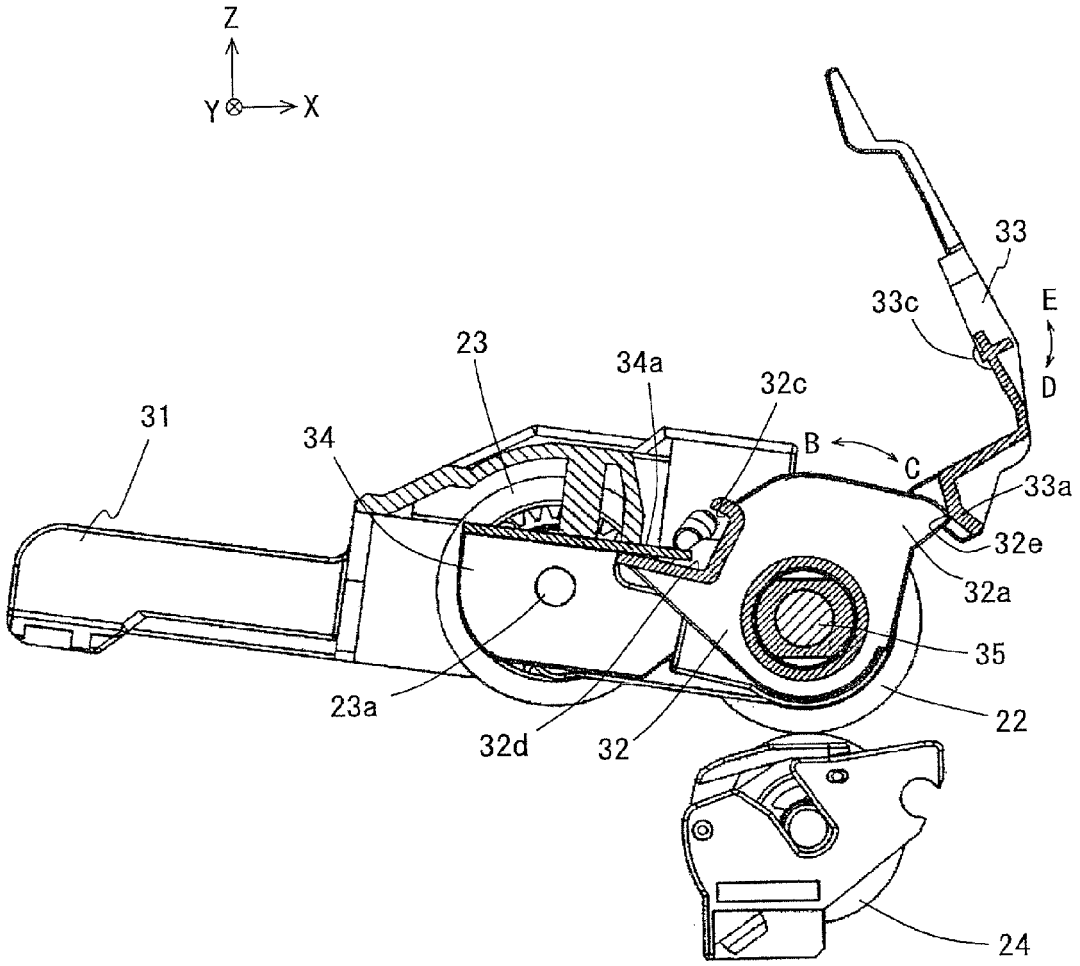
FIG. 15 is a schematic view showing the rotation operation of the manual tray according to Embodiment 1.

Thereafter, when the MPT frame 31 is in a certain rotational region during the rotation in the direction shown by the arrow B toward the opening rotational position shown in FIG. 16, the apex portion 32*e* of the engaging protrusion 32*a* of the first MPT lever 32 slides on a wall surface (facing the engaging protrusion 32*a*) of the engaging wall 33*a* of the second MPT lever 33. The wall surface of the engaging wall 33*a* has, for example, a V-shaped cross section, and includes a ridge portion 33*d* at a center portion thereof as shown in FIG. 16. As shown in FIG. 15, when the apex portion 32*e* of the engaging protrusion 32*a* of the first MPT lever 32 contacts the ridge portion 33*d* (FIG. 16), a rotating amount of the second MPT lever 33 in the direction shown by the arrow E becomes the largest.

Therefore, when the MPT frame 31 further rotates in the direction shown by the arrow B from the state shown in FIG. 14 following the rotation of the manual tray 21, the first MPT lever 32 pushes the engaging wall 33*a* of the second MPT lever 33 to cause the second MPT lever 33 to rotate in the direction shown by the arrow E, at least until the apex portion 32*e* of the first MPT lever 32 reaches the ridge portion 33*d* (FIG. 16) of the engaging wall 33*a* as shown in FIG. 15.

During the rotation of the first MPT lever 32 in the direction shown by the arrow B, when the apex portion 32*e* of the first MPT lever 32 moves beyond the ridge portion 33*d* of the engaging wall 33*a* of the second MPT lever 33, a load resisting the rotation of the first MPT lever 32 in the direction shown by the arrow B disappears. Therefore, the first MPT lever 32 rotates in the direction shown by the arrow B by gravity and by action of the second MPT lever 33 rotating to return to the free state. The rotation of the first MPT lever 32 in the direction shown by the arrow B stops when the normal-direction contact portion 32*c* contacts the regulating portion 34*a* of the MPT sub-frame 34 fixed to the MPT frame 31 staying at the opening rotational position. In this state, the second MPT lever 33 is in a state where the engaging wall 33*a* slightly contacts the apex portion 32*e* of the first MPT lever 32.

In this regard, although the engaging wall 33*a* slightly contacts the apex portion 32*e* in this example, it is also possible that the engaging wall 33*a* is slightly apart from the apex portion 32*e* so that the second MPT lever 33 is in the free state.

The state shown in FIG. 16 corresponds to the state shown in FIG. 9. In other words, the recording sheet is not placed on the sheet receiving portion 21*b* shown in FIG. 9, and the first MPT lever 32 is in the non-sheet-detection position where the sheet contact portion 32*b* fits into the receiving recess 21*e* (FIG. 8) of the sheet receiving portion 21*b*. When the first MPT lever 32 is in the non-sheet-detection position, the normal-direction contact portion 32*c* of the first MPT lever 32 contacts the regulating portion 34*a* of the MPT sub-frame 34, and the first MPT lever 32 is prevented from rotating in the direction shown by the arrow B.

In contrast, as shown in FIG. 10, when the recording sheet 55 is placed on the sheet receiving portion 21*b*, the sheet contact portion 32*b* of the first MPT lever 32 contacts the surface of the recording sheet 55 placed on the sheet receiving portion 21*b*. By contact with the recording sheet, the first MPT lever 32 rotates in a direction shown by the arrow C, but stays in the sheet-detection position where the reverse-direction contact portion 32*d* does not contact the regulating portion 34*a* of the MPT sub-frame 34 fixed to the MPT frame 31 staying at the opening rotational position. The switching of the mechanical switch 36 between the ON state and the OFF state by the second MPT lever 33 is as described above.

Next, a rotation (i.e., a closing operation) of the manual tray 21 from the opening position (FIG. 3) to the closing position (FIG. 2) will be described.

In the closing operation of the manual tray 21, the manual tray 21, the MPT roller 22, the MPT sub-roller 23, the first MPT lever 32 and the second MPT lever 33 respectively operate in a reverse order with respect to that in the opening operation of the manual tray 21. At least in a period from the state shown in FIG. 16 to the state where the apex portion 32*e* of the first MPT lever 32 moves beyond the ridge portion 33*d*, and a period from the state shown in FIG. 12 to the state shown in FIG. 11, the regulating portion 34*a* of the MPT sub-frame 34 and the normal-direction contact portion 32*c* contact each other. When the manual tray 21 is in the closing position shown in FIG. 11, the second MPT lever 33 is apart from the first MPT lever 32. In other words, the second MPT lever 33 is in the free state.

In this regard, the manual tray 21, the MPT frame 31, the MPT sub-frame 34, the MPT roller 22, the MPT sub-roller 23, the first MPT lever 32, the second MPT lever 33, the mechanical switch 36 and the control unit 40 constitute a medium conveying device. Further, the first MPT lever 32, the second MPT lever 33 and the mechanical switch 36 constitute a sheet detection system (i.e., a medium detection system).

As described above, according to the medium conveying device of Embodiment 1, the sheet detection system (i.e., the first MPT lever 32, the second MPT lever 33 and the mechanical switch 36) for detecting presence or absence of the sheet placed on the manual tray 21 is not provided on the manual tray 21, but is provided on the main body 101 of the printer 100. Therefore, it becomes possible to simplify a configuration of the rotatable manual tray 21, and to achieve a sheet detection function.

Further, when the manual tray 21 is closed, the first MPT lever 32 and the second MPT lever 33 are apart from each other, and therefore freedom in arrangement of the levers 32 and 33 increases. As a result, it becomes easy to secure a space, and to eliminate cause of malfunction of the sheet detection system.

Embodiment 2

Figure 17:
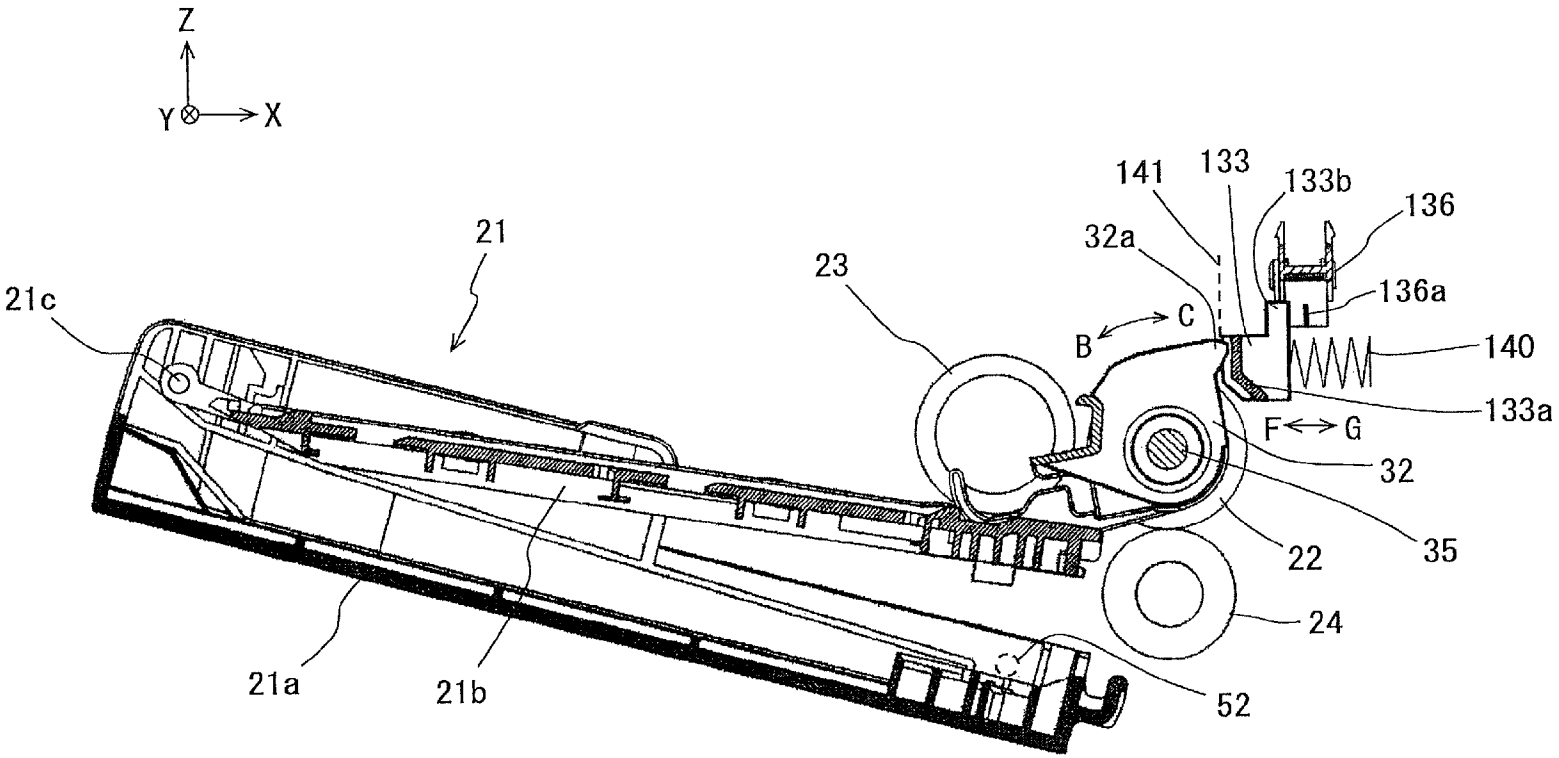
FIG. 17 is a sectional view showing a part of a printer according to Embodiment 2 taken along the same line as line IX-IX in FIG. 4.

FIG. 17 is a sectional view of a part of a printer according to Embodiment 2 taken along the same line as line IX-IX in FIG. 4. FIGS. 19 through 24 are schematic views for illustrating an operation of the manual tray 21 according to Embodiment 2.

The printer of Embodiment 2 is different from the printer 100 of Embodiment 1 in that the printer of Embodiment 2 includes an MPT slider 133 and a photosensor 136 in instead of the second MPT lever 33 and the mechanical switch 36 of the printer 100 of Embodiment 1. Therefore, elements which are the same as those of the printer 100 (FIG. 1) of Embodiment 1 are assigned with the same reference numerals, and duplicate explanations will be omitted. Description will be focused on a difference between the printer of Embodiment 2 and the printer 100 of Embodiment 1. In this regard, the elements of the printer of Embodiment 2 are the same as those of the printer 100 shown in FIG. 1 except for the second MPT lever 33 and the mechanical switch 36, and therefore FIGS. 1 through 8 will be referred as necessary.

FIG. 17 shows a state where the manual tray base 21*a* of the manual tray 21 is in the closing position, and the sheet receiving portion 21*b* contacts the MPT sub-roller 23. The MPT slider 133 as a second displacement member is supported by the main body frame 51 so that the MPT slider 133 is slidable (more specifically, linearly movable) in directions shown by arrows F and G. The MPT slider 133 includes an engaging wall 133*a* (i.e., a second engaging portion) and a light interrupting portion 133*b* (i.e., a to-be-detected portion). The engaging wall 133*a* is provided at an end portion of the MPT slider 133. The MPT slider 133 is disposed at a position where the engaging wall 133*a* is contactable with the engaging protrusion 32*a* of the first MPT lever 32. The light interrupting portion 133*b* is provided on an upper part of the other end portion of the MPT slider 133. When the MPT slider 133 is in a certain rotational position, the light interrupting portion 133*b* interrupts a light path of a light detector 136*a* of a photosensor 136 (i.e., a detection unit). The MPT slider 133 is biased by a coil spring 140 (i.e., a biasing unit) provided between the MPT slider 133 and the main body frame 51. The coil spring 140 biases the MPT slider 133 in the direction shown by the arrow F in which the MPT slider 133 contacts the engaging protrusion 32*a* of the first MPT lever 32.

The photosensor 136 is in an OFF state when the light detector 136*a* receives light emitted by a not shown light emitting portion. The photosensor 136 in an ON state when the light detector 136*a* does not receive the light (i.e., when the light is interrupted by the light interrupting portion 133*b* of the MPT slider 133).

As shown in FIG. 17, when the manual tray base 21*a* of the manual tray 21 is in the opening position, and the recording sheet is not placed on the sheet receiving portion 21*b*, the first MPT lever 32 is going to rotate in the direction shown by the arrow B by gravity. However, the sheet contact portion 32*b* (FIG. 18) of the first MPT lever 32 fits into the receiving recess 21*e* (FIG. 8) of the sheet receiving portion 21*b*, and the rotation of the first MPT lever 32 is prevented (see FIG. 24). That is, the first MPT lever 32 is held in the non-sheet-detection position.

In this state, the MPT slider 133 contacts a stopper 141 provided on the main body frame 51, and is prevented from moving in the direction shown by the arrow F. The MPT slider 133 is not in a position (i.e., a light interrupting position) where the light interrupting portion 133*b* interrupts the light of the photosensor 136, and the photosensor 136 is in the OFF state. In this state, the engaging wall 133*a* of the MPT slider 133 and the engaging protrusion 32*a* of the first MPT lever 132 are slightly apart from each other. However, it is also possible that the engaging wall 133*a* of the MPT slider 133 and the engaging protrusion 32*a* of the first MPT lever 132 slightly contact each other.

Figure 18:
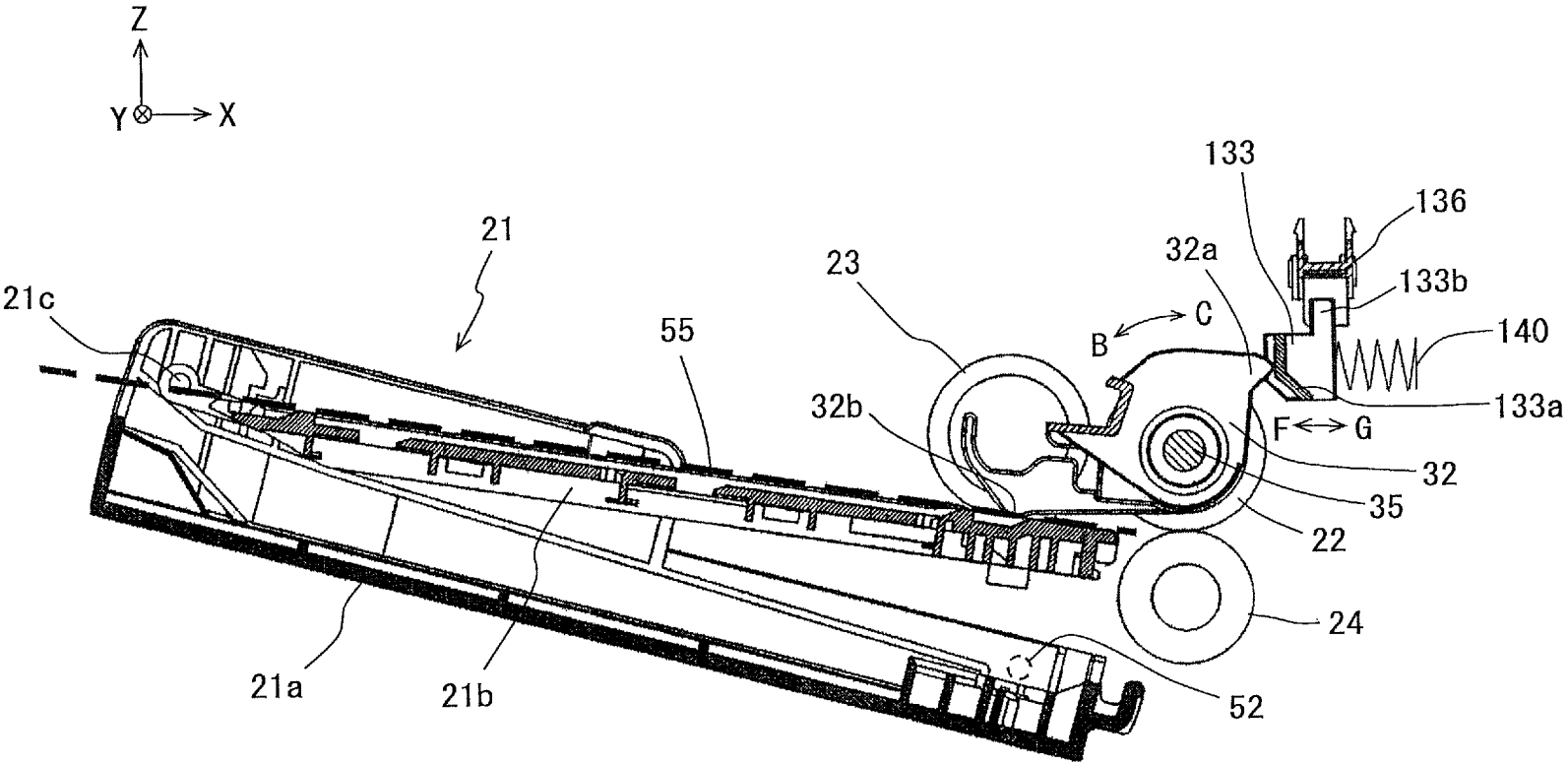
FIG. 18 is a schematic view showing a state where a recording sheet is placed on a sheet receiving portion according to Embodiment 2.

FIG. 18 shows a state where the manual tray base 21*a* of the manual tray 21 is in the opening position, and the recording sheet 55 (shown by a long dashed line) is placed on the sheet receiving portion 21*b*. In this state, the sheet contact portion 32*b* of the first MPT lever 32 contacts the surface of the recording sheet 55, and the first MPT lever 32 is held at the sheet-detection position. The sheet-detection position is a position where the first MPT lever 32 rotates in the direction shown by the arrow C from the non-sheet-detection position.

As shown in FIGS. 17 and 18, shapes and positions of the engaging protrusion 32*a* of the first MPT lever 32 and the engaging wall 133*a* of the MPT slider 133 are determined so that the engaging protrusion 32*a* of the first MPT lever 32 keeps pushing the engaging wall 133*a* of the MPT slider 133 to cause the MPT slider 133 to move in the direction shown by the arrow G, at least while the first MPT lever 32 rotates from the non-sheet-detection position (FIG. 17) to the sheet-detection position (FIG. 18).

Therefore, when the first MPT lever 32 is in the sheet-detection position, the MPT slider 133 moves to the light interrupting position (where the light interrupting portion 133*b* interrupts the light of the photosensor 136) as shown in FIG. 18, and the photosensor 136 is turned to the ON state.

In this way, the photosensor 136 is in the OFF state when the manual tray base 21*a* of the manual tray 21 is in the opening position, and when the recording sheet is not placed on the sheet receiving portion 21*b*. The photosensor 136 is in the ON state when the manual tray base 21*a* of the manual tray 21 is in the opening position, and when the recording sheet is placed on the sheet receiving portion 21*b*. The photosensor 136 outputs an ON signal and an OFF signal (i.e., a medium detection signal) corresponding to the ON state and the OFF state to the control unit 40 (FIG. 1). The control unit 40 receives the medium detection signal from the photosensor 136. When receiving the ON signal, the control unit 40 determines that the recording sheet is placed on the sheet receiving portion 21*b*. When receiving the OFF signal, the control unit 40 determines that the recording sheet is not placed on the sheet receiving portion 21*b*.

Operations of the manual tray 21, the MPT roller 22, the MPT sub-roller 23, the first MPT lever 32 and the MPT slider 133 during the rotation (i.e., the opening operation) of the manual tray 21 from the closing position (FIG. 2) to the opening position (FIG. 3) will be described.

As described in Embodiment 1, when the manual tray 21 rotates from the closing position (FIG. 2) to the opening position (FIG. 3), the MPT frame 31 rotates in the direction shown by the arrow B about the shaft 35 from the closing rotational position (FIG. 19) where the MPT sub-roller 23 is located directly above the MPT roller 22 to the opening rotational position (FIG. 24) where the MPT sub-roller 23 is located substantially at the same height as but slightly higher than the MPT roller 22.

Figure 19:
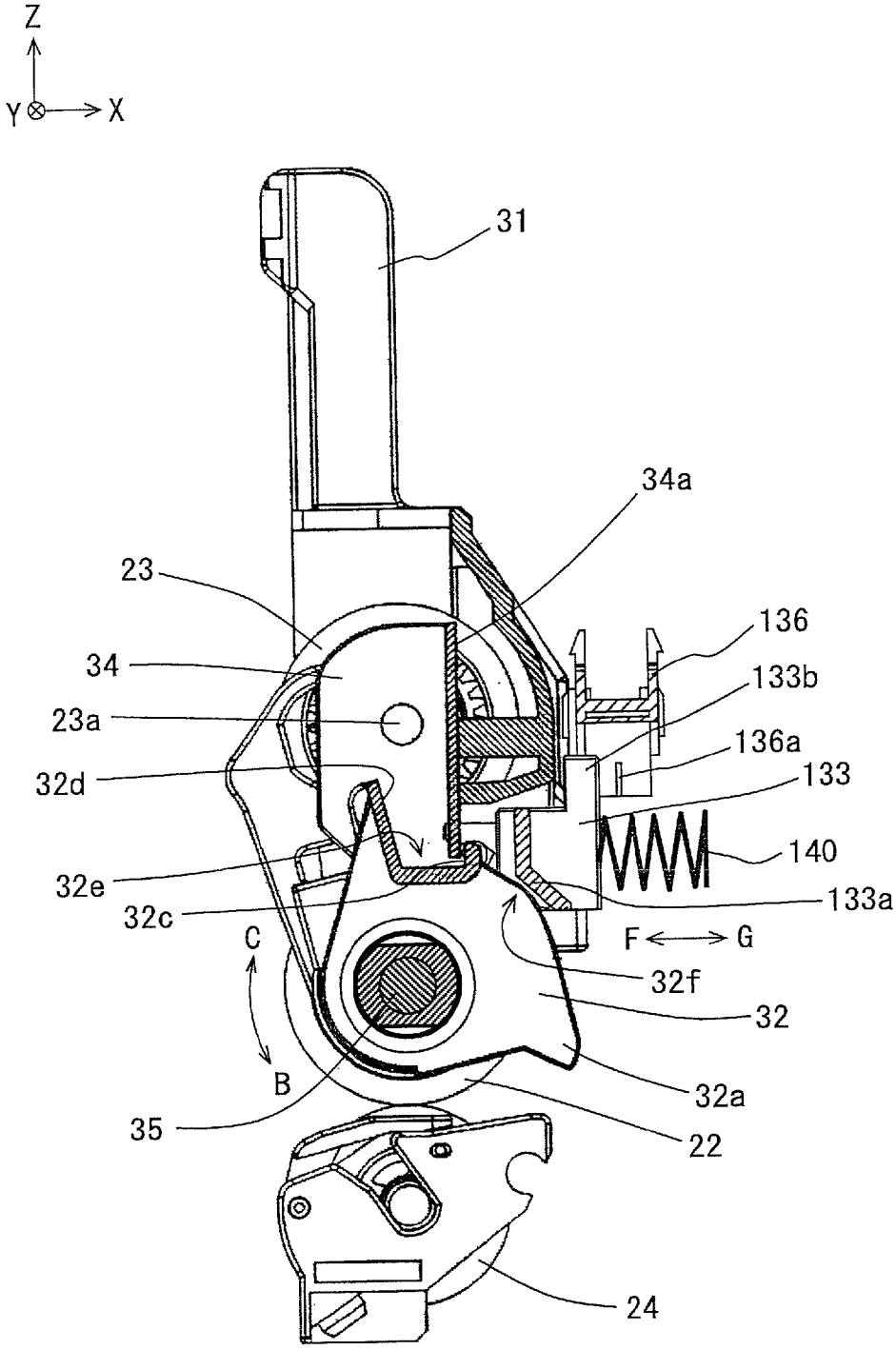
FIG. 19 is a schematic view showing a rotation operation of a manual tray according to Embodiment 2.

As shown in FIG. 19, when the MPT frame 31 is in the closing rotational position, the first MPT lever 32 is going to rotate in the direction shown by the arrow B by gravity. However, the normal-direction contact portion 32*c* of the first MPT lever 32 keeps contacting the regulating portion 34*a* of the MPT sub-frame 34. The engaging wall 133*a* of the MPT slider 133 contacts the stopper 141 (FIG. 17), and the MPT slider 133 is prevented from moving in the direction shown by the arrow F. Therefore, the MPT slider 133 is kept in position apart from the first MPT lever 32.

When the MPT frame 31 rotates in the direction shown by the arrow B according to the rotation of the manual tray 21, the first MPT lever 32 rotates in the direction shown by the arrow B while keeping the normal-direction contact portion 32*c* and the regulating portion 34*a* of the MPT sub-frame 34 in contact with each other, until the first MPT lever 32 contacts the MPT slider 133. When the engaging protrusion 32*a* of the first MPT lever 32 contacts the engaging wall 133*a* of the MPT slider 133, the rotation of the first MPT lever 32 in the direction shown by the arrow E is temporarily stopped by a biasing force of the coil spring 140.

Figure 20:
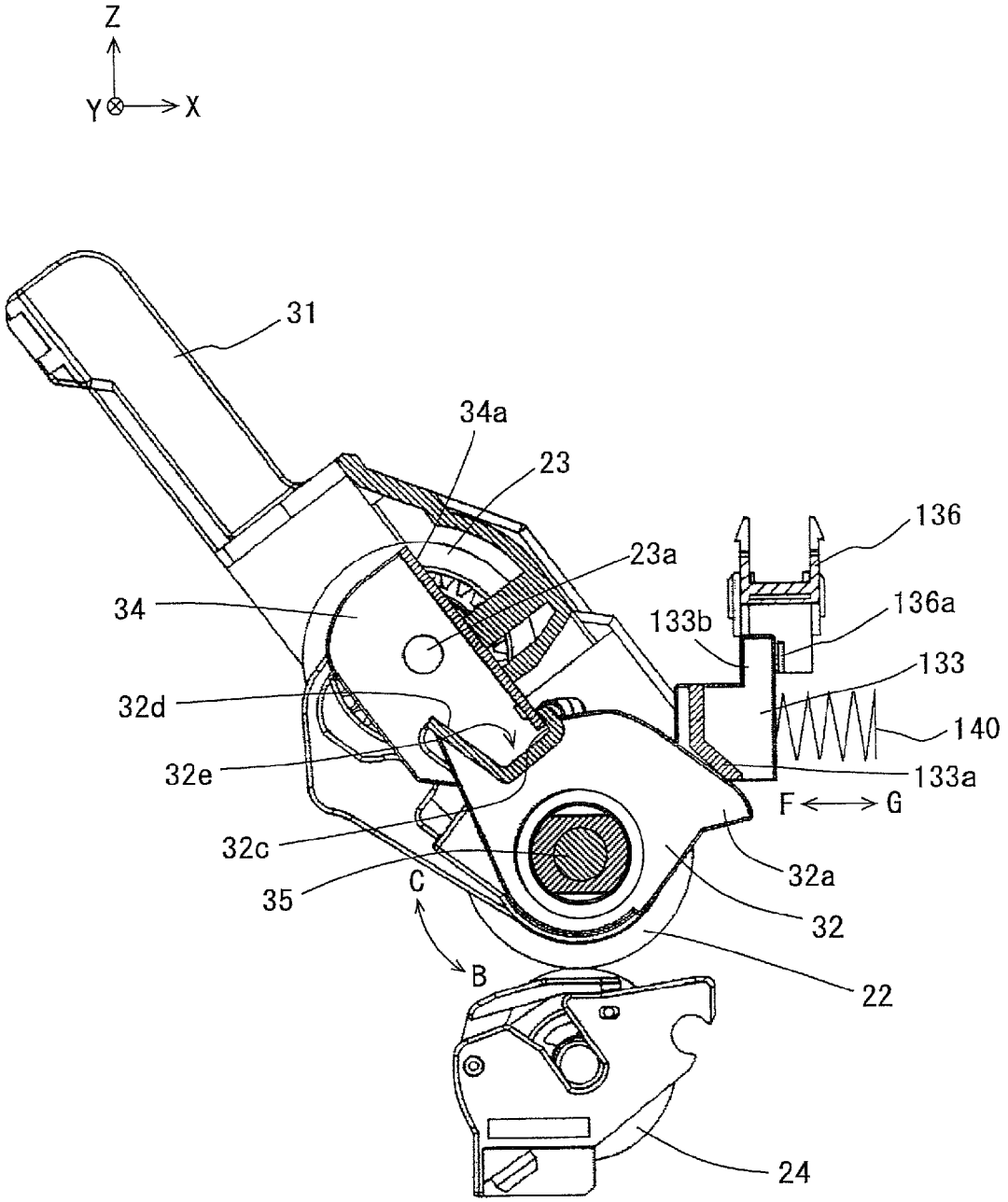
FIG. 20 is a schematic view showing the rotation operation of the manual tray according to Embodiment 2.
Figure 21:
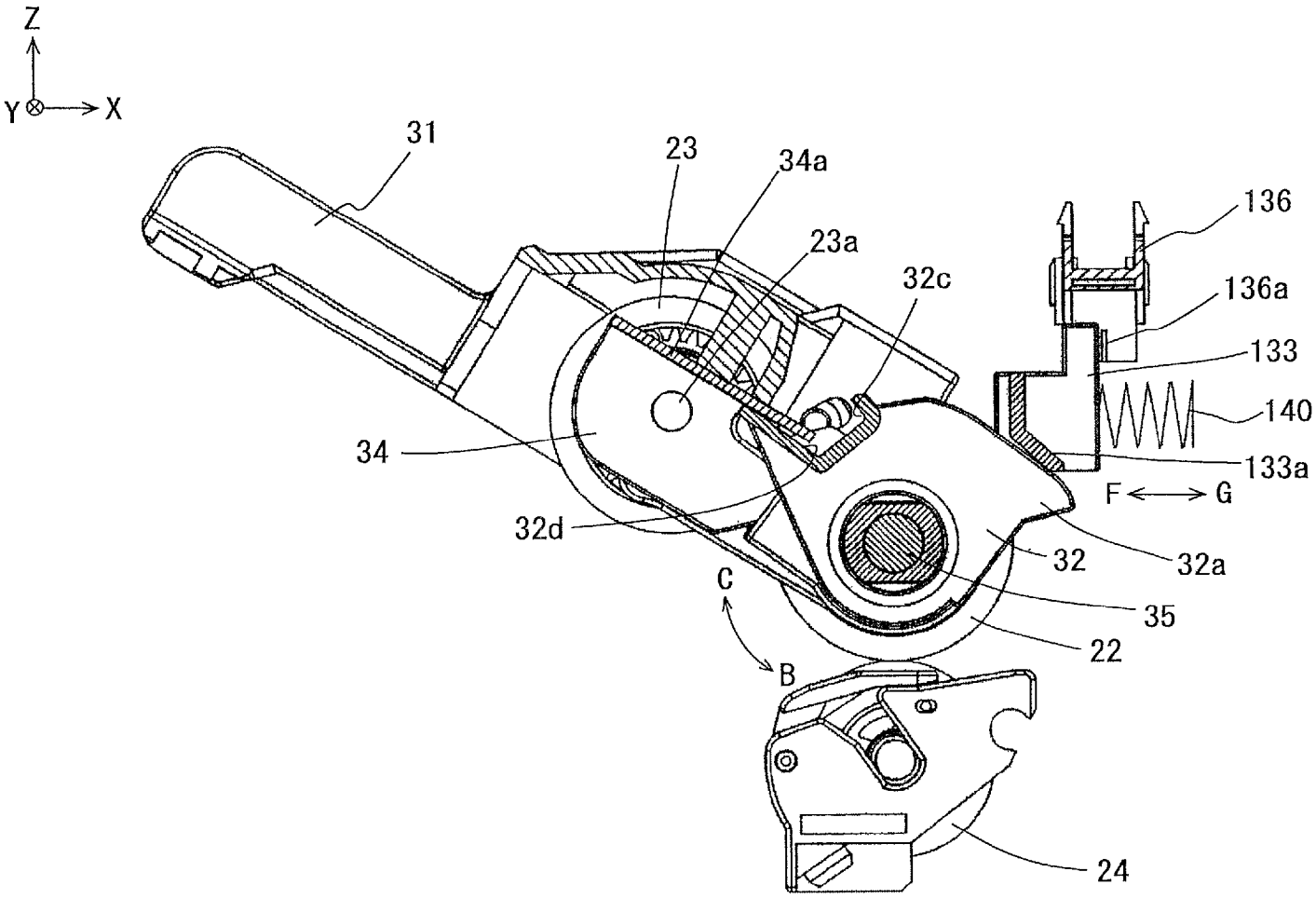
FIG. 21 is a schematic view showing the rotation operation of the manual tray according to Embodiment 2.

The first MPT lever 32 keeps a rotation-stopped state until the MPT frame 32 further rotates in the direction shown by the arrow B from the state shown in FIG. 20 until the regulating portion 34*a* of the MPT sub-frame 34 contacts the reverse-direction contact portion 32*d* as shown in FIG. 21. When the MPT frame 31 further rotates in the direction shown by the arrow B after the regulating portion 34*a* of the MPT sub-frame 34 contacts the reverse-direction contact portion 32*d* of the first MPT lever 32, the first MPT lever 32 rotates in the direction shown by the arrow B. Therefore, the engaging protrusion 32*a* of the first MPT lever 32 starts pushing a lower end portion of the engaging wall 133*a* of the MPT slider 133, so that the MPT slider 133 moves in the direction shown by the arrow G resisting the biasing force of the coil spring 140.

Figure 22:
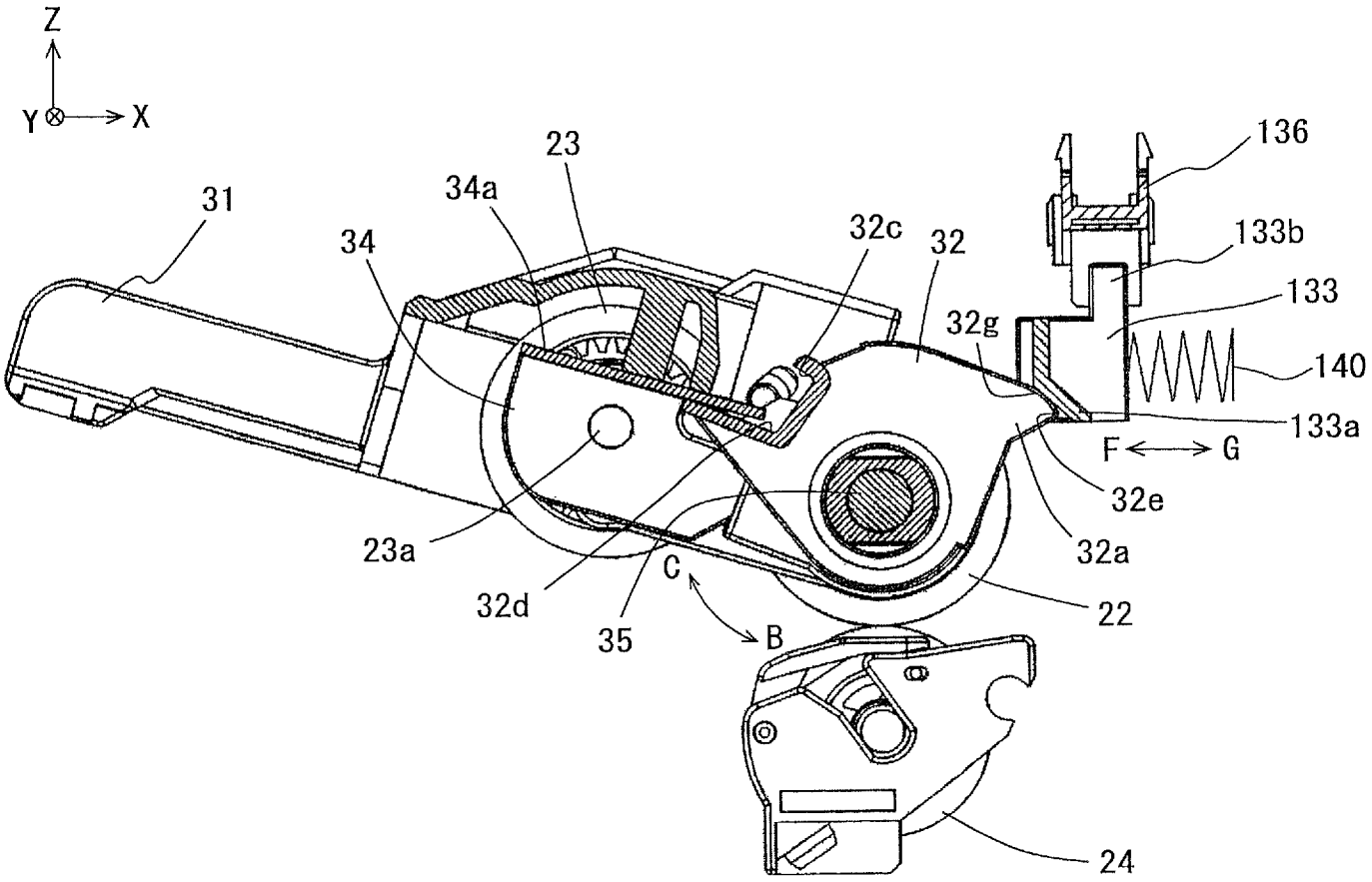
FIG. 22 is a schematic view showing the rotation operation of the manual tray according to Embodiment 2.

FIG. 22 shows a state where the MPT frame 31 rotates in the direction shown by the arrow B from the state shown in FIG. 21 to reach a position where the apex portion 32*e* of the engaging protrusion 32*a* of the first MPT lever 32 (that rotates following the rotation of the MPT frame 31) engages the engaging wall 133*a* of the MPT slider 133. During this rotation, the engaging wall 133*a* slides on the projecting guide portion 32*g* of the engaging protrusion 32*a*, and is pushed according to the projecting shape of the engaging protrusion 32*a*.

Figure 23:
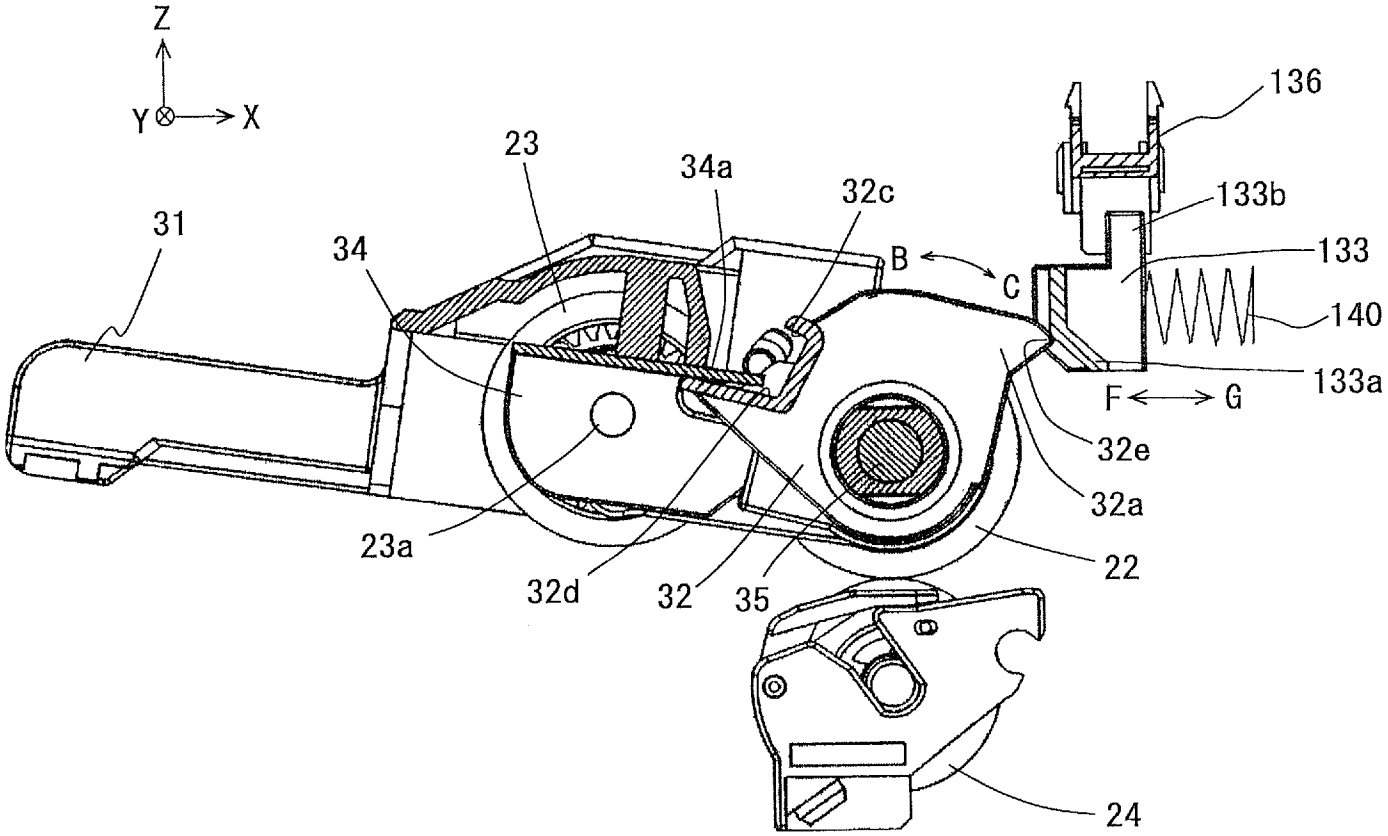
FIG. 23 is a schematic view showing the rotation operation of the manual tray according to Embodiment 2.
Figure 24:
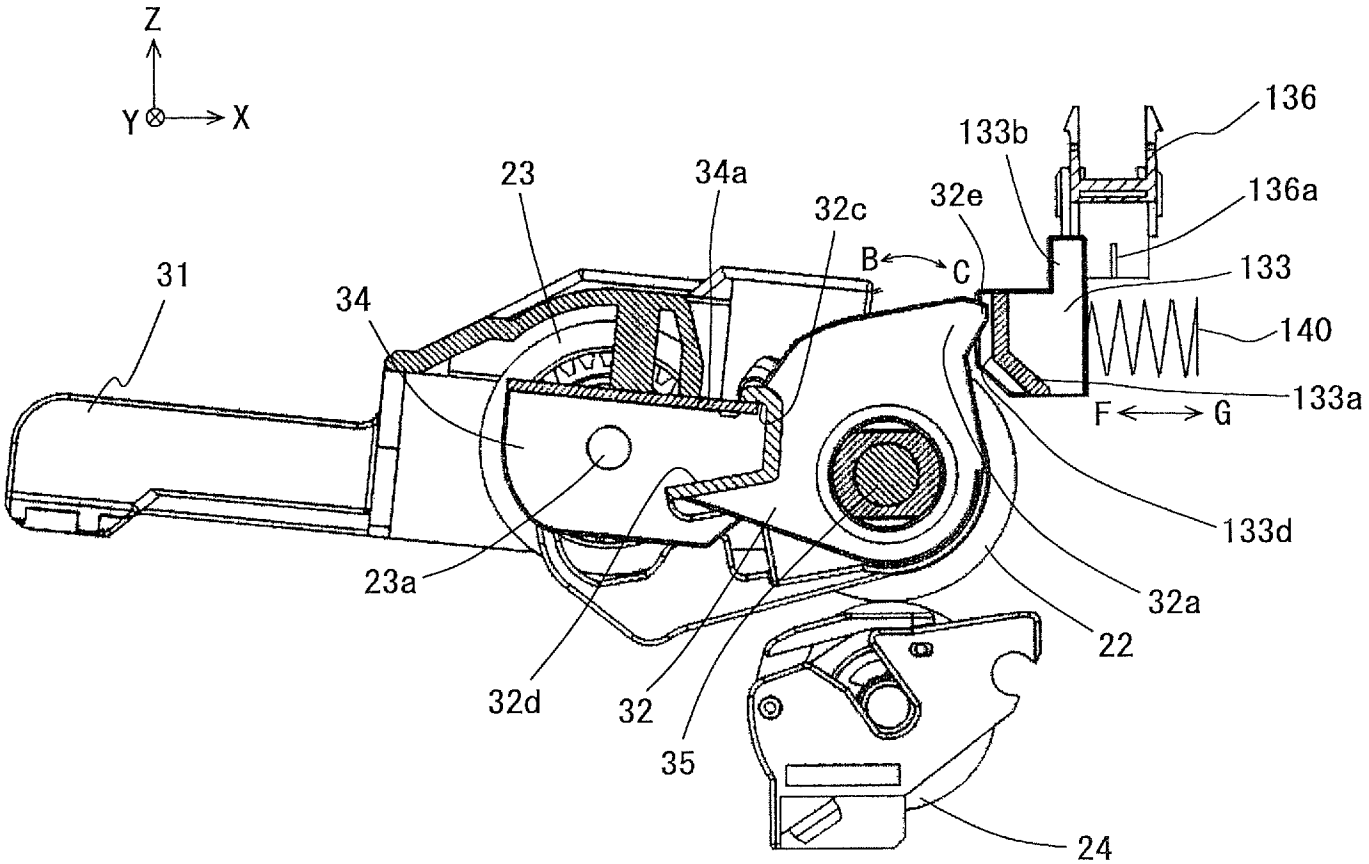
FIG. 24 is a schematic view showing the rotation operation of the manual tray according to Embodiment 2.

Thereafter, when the MPT frame 31 is in a certain rotational region during the rotation in the direction shown by the arrow B toward the opening rotational position shown in FIG. 24, the apex portion 32*e* of the engaging protrusion 32*a* of the first MPT lever 32 slides on a wall surface (facing the apex portion 32*e*) of the engaging wall 133*a* of the MPT slider 133. The wall surface has, for example, a V-shaped cross section, and includes a ridge portion 133*d* at a center portion thereof as shown in FIG. 24. As shown in FIG. 23, when the apex portion 32*e* of the engaging protrusion 32*a* of the first MPT lever 32 contacts the ridge portion 133*d* (FIG. 24), a moving amount of the MPT slider 133 in the direction shown by the arrow G becomes the largest.

Therefore, when the MPT frame 31 further rotates in the direction shown by the arrow B from the state shown in FIG. 22, the first MPT lever 32 pushes the engaging wall 133*a* of the MPT slider 133 to cause the MPT slider 133 to move in the direction shown by the arrow G, at least until the apex portion 32*e* of the first MPT lever 32 reaches the ridge portion 133*d* (FIG. 24) of the engaging wall 133*a* as shown in FIG. 23.

During the rotation of the first MPT lever 32 in the direction shown by the arrow B, when the apex portion 32*e* moves beyond the ridge portion 133*d* of the engaging wall 133*a* of the MPT slider 133, a load resisting the rotation of the first MPT lever 32 in the direction shown by the arrow B disappears. Therefore, the first MPT lever 32 starts rotating in the direction shown by the arrow B by gravity and by action of the MPT slider 133 biased by the coil spring 140. The rotation of the first MPT lever 32 in the direction shown by the arrow B stops when the normal-direction contact portion 32*c* contacts the regulating portion 34*a* of the MPT sub-frame 34 fixed to the MPT frame 31 staying at the opening rotational position.

The state shown in FIG. 24 corresponds to the state shown in FIG. 17. In other words, the recording sheet is not placed on the sheet receiving portion 21*b* shown in FIG. 17, and the first MPT lever 32 is in the non-sheet-detection position where the sheet contact portion 32*b* fits into the receiving recess 21*e* (FIG. 8) formed on the sheet receiving portion 21*b*. The first MPT lever 32 is kept apart from the MPT slider 133 which is prevented from moving in the direction shown by the arrow F by the stopper 141. Further, in this non-sheet-detection position, the first MPT lever 32 is prevented from rotating in the direction shown by the arrow B, since the normal-direction contact portion 32*c* contacts the regulating portion 34*a* of the MPT sub-frame 34.

In contrast, as shown in FIG. 18, when the recording sheet 55 is placed on the sheet receiving portion 21*b*, the sheet contact portion 32*b* of the first MPT lever 32 contacts the surface of the recording sheet 55 placed on the sheet receiving portion 21*b*. By contact with the recording sheet, the first MPT lever 32 rotates in the direction shown by the arrow C, but stays in the sheet-detection position in which the reverse-direction contact portion 32*d* does not contact the regulating portion 34*a* of the MPT sub-frame 34 fixed to the MPT frame 31 staying at the opening rotational position. The switching of the photosensor 136 between the ON state and the OFF state by the light interrupting portion 133*b* of the MPT slider 133 is as described above.

Next, the rotation (i.e., the closing operation) of the manual tray 21 from the opening position (FIG. 3) to the closing position (FIG. 2) will be described.

In the closing operation of the manual tray 21, the manual tray 21, the MPT roller 22, the MPT sub-roller 23, the first MPT lever 32 and the MPT slider 133 respectively operate substantially in a reverse order with respect to that in the opening operation of the manual tray 21. When the manual tray 21 is in the closing position shown in FIG. 19, the MPT slider 133 is apart from the first MPT lever 32, and is in the free state.

In this regard, the first MPT lever 32, the MPT slider 133 and the photosensor 136 constitute a sheet detection system (i.e., a medium detection system).

As described above, according to the medium conveying device of Embodiment 2, the sheet detection system (i.e., the first MPT lever 32, the MPT slider 133 and the photosensor 136) for detecting presence or absence of the sheet placed on the manual tray 21 is not provided on the manual tray 21, but is provided on the main body of the printer. Therefore, it becomes possible to simplify a configuration of the rotatable manual tray 21, and to achieve a sheet detection function.

Further, when the manual tray 21 is closed, the first MPT lever 32 and the MPT slider 133 are apart from each other, and therefore freedom in arrangement of the levers increases. As a result, it becomes easy to secure a space, and to eliminate cause of malfunction of the sheet detection system.

Furthermore, the MPT slider 133 and the photosensor 136 of Embodiment 2 can be provided in a smaller space than the second MPT lever 33 and the mechanical switch 36 of Embodiment 1. Therefore, the medium conveying device of Embodiment 2 is applicable to more various types of apparatuses.

In the above described embodiments, the monochromatic electrophotographic printer has been described as an example of the image forming apparatus. However, the present invention is not limited to the monochromatic electrophotographic printer, but is also applicable to a color electrophotographic printer. Further, the present invention is applicable to, for example, an MFP (Multi-Function Peripheral), a facsimile machine, a copier or the like.

While the preferred embodiments of the present invention have been illustrated in detail, it should be apparent that modifications and improvements may be made to the invention without departing from the spirit and scope of the invention as described in the following claims.

What is claimed is:

1. A medium conveying device provided on an image forming apparatus, the medium conveying device comprising:

a medium placing tray provided on a main body of the image forming apparatus so as be openable and closable with respect to the main body, the medium placing tray including a placing portion on which a medium is placed;

a first displacement member including a contact portion that contacts the medium placed on the placing portion and a first engaging portion;

a second displacement member including a second engaging portion that engages the first engaging portion;

a detecting unit that detects a displacement state of the second displacement member; and a determination unit that determines presence or absence of the medium on the placing portion based on a detection result of the detection unit, a feeding unit that feeds the medium on the placing portion in a medium conveying direction; and a first roller provided downstream of the feeding unit in the medium conveying direction, the first roller being rotatable about a rotation axis, wherein the first engaging portion and the second engaging portion engage each other and disengages from each other in conjunction with opening and closing operation of the medium placing tray, wherein the first displacement member is displaced so as to be rotatable about a first rotation axis coaxial with the rotation axis of the first roller.

2. The medium conveying device according to claim 1, wherein the first engaging portion and the second engaging portion engage each other in conjunction with the opening operation of the medium placing tray.

3. The medium conveying device according to claim 1, wherein the first engaging portion and the second engaging portion disengage from each other in conjunction with the closing opening operation of the medium placing tray.

4. The medium conveying device according to claim 1, wherein the contact portion is disposed upstream of the first rotation axis in the medium conveying direction, and wherein the first engaging portion is disposed downstream of the first rotation axis in the medium conveying direction.

5. The medium conveying device according to claim 1, wherein the feeding unit includes a second roller and a holder that rotatably holds the second roller, wherein the holder is rotatable about the first rotation axis.

6. The medium conveying device according to claim 5, wherein the holder includes a third engaging portion, wherein the third engaging portion rotates in conjunction with the opening and closing operation of the medium placing tray, and wherein the third engaging portion engages the first displacement member to rotate in a same direction as the first displacement member.

7. A medium conveying device provided on an image forming apparatus, the medium conveying device comprising:

a medium placing tray provided on a main body of the image forming apparatus so as be openable and closable with respect to the main body, the medium placing tray including a placing portion on which a medium is placed;

a first displacement member including a contact portion that contacts the medium placed on the placing portion and a first engaging portion;

a second displacement member including a second engaging portion that engages the first engaging portion;

a detecting unit that detects a displacement state of the second displacement member; and a determination unit that determines presence or absence of the medium on the placing portion based on a detection result of the detection unit, wherein the first engaging portion and the second engaging portion engage each other and disengages from each other in conjunction with opening and closing operation of the medium placing tray;

wherein the second displacement member is rotatable about a second rotation axis;

wherein the second displacement member includes a to-be-detected portion detected by the detecting unit; and wherein the to-be-detected portion is disposed on a side of the second displacement member opposite to the second engaging portion with respect to the second rotation axis.

8. A medium conveying device provided on an image forming apparatus, the medium conveying device comprising:

a medium placing tray provided on a main body of the image forming apparatus so as be openable and closable with respect to the main body, the medium placing tray including a placing portion on which a medium is placed;

a first displacement member including a contact portion that contacts the medium placed on the placing portion and a first engaging portion;

a second displacement member including a second engaging portion that engages the first engaging portion;

a detecting unit that detects a displacement state of the second displacement member; and a determination unit that determines presence or absence of the medium on the placing portion based on a detection result of the detection unit, wherein the first engaging portion and the second engaging portion engage each other and disengages from each other in conjunction with opening and closing operation of the medium placing tray;

wherein the second displacement member is linearly movable, and includes a to-be-detected portion detected by the detecting unit.

9. The medium conveying device according to claim 7, wherein the detection unit includes a mechanical switch having a switch lever, and wherein the switch lever is switched by the to-be-detected portion.

10. The medium conveying device according to claim 8, wherein the detection unit includes a photosensor having a light detector, and wherein a light received by the light detector is interrupted by the to-be-detected portion.

11. An image forming apparatus comprising the medium conveying device according to claim 1.

12. An image forming apparatus comprising the medium conveying device according to claim 7.

13. An image forming apparatus comprising the medium conveying device according to claim 8.

14. The medium conveying device according to claim 7, wherein the first engaging portion and the second engaging portion engage each other in conjunction with the opening operation of the medium placing tray.

15. The medium conveying device according to claim 7, wherein the first engaging portion and the second engaging portion disengage from each other in conjunction with the closing opening operation of the medium placing tray.

16. The medium conveying device according to claim 7, wherein the contact portion is disposed upstream of the first rotation axis in the medium conveying direction, and wherein the first engaging portion is disposed downstream of the first rotation axis in the medium conveying direction.

17. The medium conveying device according to claim 7, wherein the feeding unit includes a second roller and a holder that rotatably holds the second roller, wherein the holder is rotatable about the first rotation axis.

18. The medium conveying device according to claim 17, wherein the holder includes a third engaging portion, wherein the third engaging portion rotates in conjunction with the opening and closing operation of the medium placing tray, and wherein the third engaging portion engages the first displacement member to rotate in a same direction as the first displacement member.

* * * * *